US006871033B2

(12) United States Patent
Sato et al.

(10) Patent No.: US 6,871,033 B2
(45) Date of Patent: Mar. 22, 2005

(54) DEVELOPMENT UNIT WITH RESTRICTOR FOR DEVELOPING ELECTROSTATIC LATENT IMAGES WITH IMPROVED DENSITY

(75) Inventors: Shougo Sato, Seto (JP); Mitsuru Horinoe, Chita-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/374,978

(22) Filed: Feb. 28, 2003

(65) Prior Publication Data

US 2003/0175051 A1 Sep. 18, 2003

(30) Foreign Application Priority Data

Mar. 12, 2002 (JP) ..... 2002-067639
Mar. 12, 2002 (JP) ..... 2002-067640
May 14, 2002 (JP) ..... 2002-138270

(51) Int. Cl.[7] ..... G03G 15/08
(52) U.S. Cl. ..... 399/260; 399/258
(58) Field of Search ..... 399/120, 252, 399/258, 260, 262, 263, 286, 111, 113

(56) References Cited

U.S. PATENT DOCUMENTS 5,012,285 A * 4/1991 Oka et al. ..... 399/260
5,548,384 A * 8/1996 Weed ..... 399/120
5,822,664 A 10/1998 Oka et al.
5,842,091 A * 11/1998 Nakano ..... 399/258
5,943,537 A * 8/1999 Ahn ..... 399/260
6,025,106 A * 2/2000 Azuma et al. ..... 430/108.7
6,484,007 B1 * 11/2002 Ozeki et al. ..... 399/286
6,485,876 B1 * 11/2002 Takezawa et al. ..... 430/110.4
6,584,293 B1 * 6/2003 Wang et al. ..... 399/258

FOREIGN PATENT DOCUMENTS

JP 5-119621 5/1993
JP A 8-106205 4/1996
JP 8-171276 7/1996
JP A 9-6113 1/1997
JP A 10-20746 1/1998
JP B2 2952036 7/1999
JP A 2000-284595 10/2000
JP A 2000-310902 11/2000
JP 2000-347493 12/2000
JP A 2001-114193 4/2001
JP 2001-194883 7/2001
JP 2001-194883 A 7/2001
JP 2001-272854 10/2001

* cited by examiner

*Primary Examiner*—Sandra L. Brase
(74) *Attorney, Agent, or Firm*—Oliff & Berridge, PLC

(57) ABSTRACT

A development unit performing developing operation for developing electrostatic latent image with toner. The development unit includes a holding chamber wall defining a toner holding chamber, and a development chamber wall defining a development chamber in which a developing roller and a toner supply roller are provided. A partition wall is provided for partitioning the holding chamber from the development chamber. An elongated through hole is formed in the partition wall for bringing the holding chamber into fluid communication with the development chamber. An agitator is rotatably provided in the holding chamber for supplying the toner in the holding chamber into the development chamber through the through hole. A plurality of slats or grids are provided at the through hole, so that a plurality of slits are provided between neighboring slats. These slits allows the toner to pass therethrough from the holding chamber to the development chamber, and these slats restricts return of the toner from the development chamber to the holding chamber.

80 Claims, 7 Drawing Sheets

DEVELOPMENT UNIT WITH RESTRICTOR FOR DEVELOPING ELECTROSTATIC LATENT IMAGES WITH IMPROVED DENSITY

BACKGROUND OF THE INVENTION

The present invention relates to a development unit that develops electrostatic latent images.

FIG. 1 shows a development cartridge 128 that is used mounted in a laser printer. The development cartridge 128 is partitioned into a holding chamber 134*a* that holds toner and a development chamber 134*a* where the toner is used to develop images. The holding chamber 134*a* and the development chamber 134*b* are in fluid communication with each other through an opening 137. An agitator 155 is provided in the holding chamber 134*a*. The agitator 155 rotates to transport toner held in the holding chamber 134*a*, through the opening 137, and into the development chamber 134*b*. A supply roller 133, a developing roller 131, and layer thickness regulating blade 132 are disposed in the development chamber 134*b*.

When the development cartridge 128 is properly mounted in the laser printer, the developing roller 131 is disposed in confrontation with a photosensitive drum of the laser printer. When the laser printer is operated in this condition, first as the agitator 155 rotates, the agitator 155 conveys toner from the holding chamber 134*a* to the development chamber 134*b*. Rotation of the supply roller 133 supplies the toner to the developing roller 131. As the developing roller 131 rotates, the layer thickness regulating blade 132 regulates thickness of toner on the surface of the developing roller 131 to a thin film of fixed thickness.

As the developing roller 131 rotates further, the thin film of toner is brought into confrontation with the photosensitive drum. At this time, the toner develops an electrostatic latent image formed on the surface of the photosensitive drum into a visible toner image. The visible toner image is then transferred onto a sheet. In this way, a desired toner image can be formed on the sheet.

If insufficient toner is supplied to the supply roller, then insufficient amount of toner per unit surface area will be carried on the developing roller. As a result, the charge per unit area of toner will be increased. This higher charge results in less toner being shifted to the photosensitive drum during development of the electrostatic latent image, so that density of a resultant visible toner image will be lowered. Consequently, the toner image on the sheet will also be thin.

Such poor print density is most noticeable in images printed before the agitator has conveyed sufficient toner to the development chamber or after the laser printer has been left unused for a fairly long time.

SUMMARY OF THE INVENTION

It is an object of the present invention to overcome the above-described problems, and to provide a development unit that maintains sufficient image density.

Another object of the present invention is to provide an image forming device provided with such improved development unit.

These and other objects of the present invention will be attained by a development unit developing an electrostatic latent image using developing agent into a visible image including a holding chamber wall, a development chamber wall, a partition wall, a conveyor, and a restrictor. The holding chamber wall defines a holding chamber for holding therein the developing agent. The development chamber wall defines a development chamber. The partition wall is interposed between the holding chamber and the development chamber. The partition wall is formed with a through hole for bringing the holding chamber into fluid communication with the development chamber. The conveyor is disposed in the holding chamber for conveying the developing agent from the development chamber to the holding chamber through the through hole. The restrictor is provided to partly block the through hole. The restrictor allows the developing agent conveyed by the conveyor to pass through the through hole from the holding chamber to the development chamber and restricts passage of developing agent through the through hole from the development chamber to the holding chamber.

In another aspect of the invention, there is provided a process unit detachably mounted in a main casing of an image forming device. The process unit includes a drum cartridge and a development cartridge. The drum cartridge houses therein a photosensitive unit, a scorotoron charge unit, and a transfer unit. The development cartridge is attached to the drum cartridge and includes the holding chamber wall, the development chamber wall, the partition wall, the conveyor, and the restrictor.

In still another aspect of the invention, there is provided a development unit that, in a normal operation condition for image formation, develops electrostatic latent images using developing agent. The development unit includes the holding chamber wall, the development chamber wall, the partition wall partitioning the holding chamber from the development chamber, a developing agent transport unit, and a maintainer. The partition wall is formed with a through hole for bringing the holding chamber into fluid communication with the development chamber. The developing agent transport unit is adapted for pushing the developing agent in the holding chamber through the through hole to the holding chamber during the normal operation condition. The maintainer is disposed in the through hole for maintaining, at least during the normal operation condition, developing agent in the development chamber at a higher level than where the developing agent transport unit pushes the developing agent.

In still another aspect of the invention, there is provided a development unit that performs a developing operation to develop electrostatic latent images with developing agent. The development unit includes the holding chamber wall, the development chamber wall, the partition wall, and a blocking member. The blocking member is provided in association with the through hole for selectively blocking the through hole to maintain developing agent in the development chamber at a higher density with respect to total volume of the development chamber than a sifted apparent density of the developing agent.

BRIEF DESCRIPTION OF THE DRAWINGS

In the drawings;

FIG. 4(*b*) is a cross-sectional view showing the development cartridge of FIG. 4(*a*) with the pressing member in its raised condition during image forming processes of the laser printer;

FIG. 5(*b*) is a cross-sectional view similar to FIG. 5(*a*), showing the condition of the development cartridge while the development cartridge is not mounted in the laser printer;

FIG. 6(*b*) is a magnified view of FIG. 5(*a*), showing toner supply slits aligned with inter-opening ribs of the shutter member, so that toner cannot pass through the toner supply slits;

FIG. 7(*b*) is a cross-sectional view showing the development cartridge of FIG. 7(*a*), wherein the upper-side opening is opened up;

DETAILED DESCRIPTION OF THE EMBODIMENTS

Next, a laser printer mounted with a development cartridge according to a first embodiment of the present invention will be described with reference to FIGS. 2 to 6(*b*).

Figure 2:
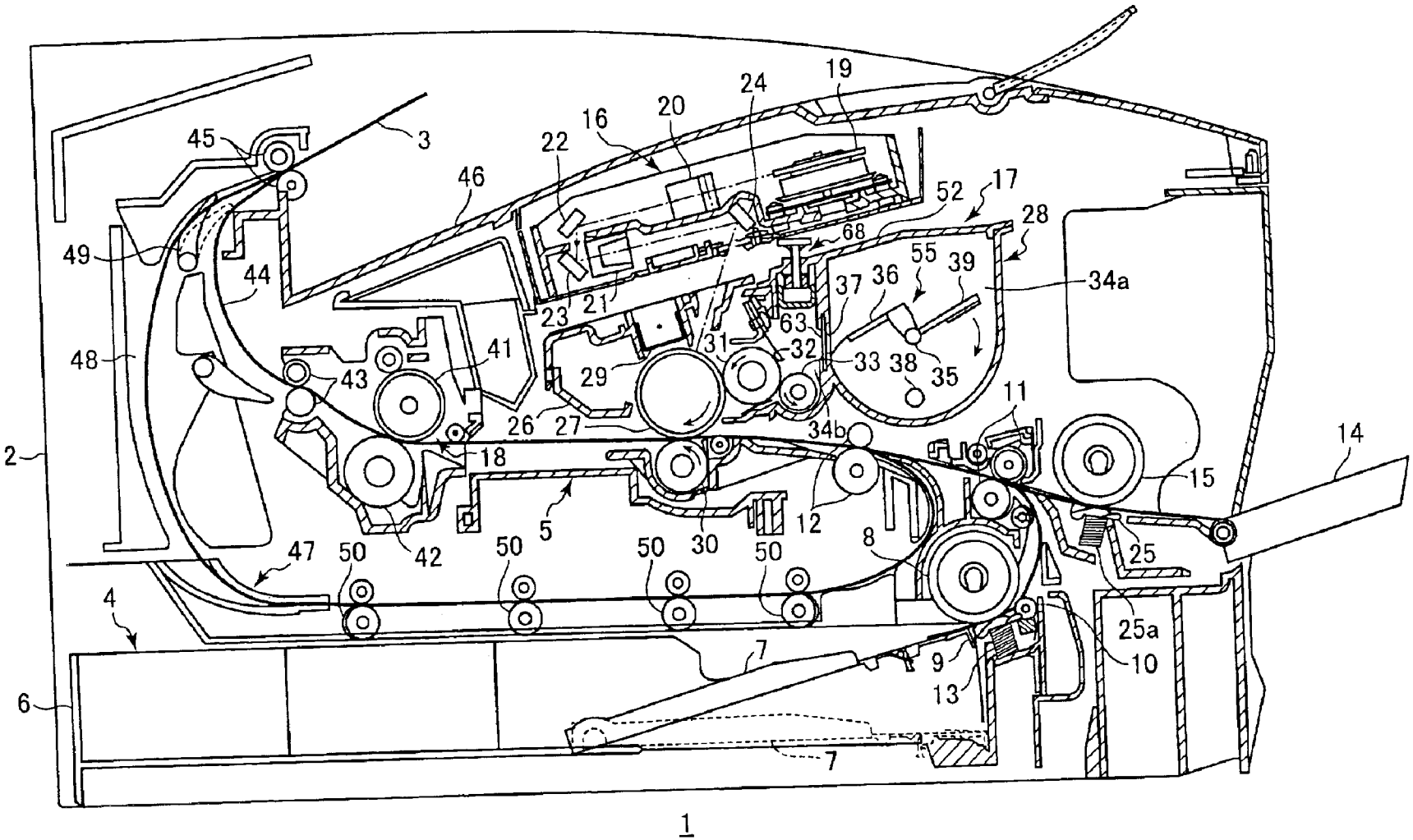
FIG. 2 is a cross-sectional view showing essential components of a laser printer according to an embodiment of the present invention.

As shown in FIG. 2, the laser printer 1 includes a main casing 2, a feeder unit 4, and an image forming unit 5. The feeder unit 4 and the image forming unit 5 are housed in the main casing 2. The feeder unit 4 supplies sheets 3 to the image forming unit 5. The image forming unit 5 forms desired images on the supplied sheets 3.

The feeder unit 4 is located within the lower section of the main casing 2 and includes a sheet supply tray 6, a sheet pressing plate 7, a sheet supply roller 8, a sheet supply pad 9, paper dust removing rollers 10, 11, and registration rollers 12. The sheet supply tray 6 is detachably mounted with respect to the main casing 2. The sheet pressing plate 7 is pivotally movably provided within the sheet supply tray 6. The sheet supply roller 8 and the sheet supply pad 9 are provided above one end of the sheet supply tray 6. The paper dust removing rollers 10, 11 are disposed downstream from the sheet supply roller 8 with respect to the direction in which the sheets 3 are transported. The registration rollers 12 are provided downstream from the paper dust removing rollers 10, 11 in the sheet transport direction of the sheets 3.

The sheet pressing plate 7 is capable of supporting a stack of sheets 3. The sheet pressing plate 7 is pivotably supported at its end furthest from the supply roller 8 so that the end of the sheet pressing plate 7 that is nearest the supply roller 8 can move vertically. Although not shown in the drawings, a spring for urging the sheet pressing plate 7 upward is provided to the rear surface of the sheet pressing plate 7. Therefore, the sheet pressing plate 7 pivots downward in accordance with increase in the amount of sheets 3 stacked on the sheet pressing plate 7. At this time, the sheet pressing plate 7 pivots around the end of the sheet pressing plate 7 farthest from the sheet supply roller 8, downward against the urging force of the spring. The sheet supply roller 8 and the sheet supply pad 9 are disposed in confrontation with each other. A spring 13 is provided beneath the sheet supply pad 9 for pressing the sheet supply pad 9 toward the sheet supply roller 8. Urging force of the spring under the sheet pressing plate 7 presses the uppermost sheet 3 on the sheet pressing plate 7 toward the supply roller 8 so that rotation of the supply roller 8 moves the uppermost sheet 3 between the supply roller 8 and the separation pad 13. In this way, one sheet 3 at a time is separated from the stack and supplied to the paper dust removing rollers 10, 11.

The paper dust removing rollers 10, 11 remove paper dust from the supplied sheets 3 and further convey them to the registration rollers 12. The pair of registration rollers 12 performs a desired registration operation on the supplied sheets 3. Then the sheets 3 are transported to an image formation position. In the image formation position a photosensitive drum 27 and a transfer roller 30 contact each other. In other words, the image formation position is the transfer position where the visible toner image is transferred from the surface of the photosensitive drum 27 to a sheet 3 as the sheet 3 passes between the photosensitive drum 27 and the transfer roller 30.

The feeder unit 4 further includes a multipurpose tray 14, a multipurpose sheet supply roller 15, and a multipurpose sheet supply pad 25. The multipurpose sheet supply roller 15 and the multipurpose sheet supply pad 25 are disposed in confrontation with each other and are for supplying sheets 3 that are stacked on the multipurpose tray 14. A spring 25*a* provided beneath the multipurpose sheet supply pad 25 presses the multipurpose sheet supply pad 25 up toward the multipurpose sheet supply roller 15. Rotation of the multipurpose sheet supply roller 15 moves sheets 3 one at a time from the stack on the multipurpose tray 14 to a position between the multipurpose sheet supply pad 25 and the multipurpose sheet supply roller 15 so that the sheets 3 on the multipurpose tray 14 can be supplied one at a time to the image formation position.

The image forming section 5 includes a scanner section 16, a process unit 17, and a fixing section 18. The scanner section 16 is provided at the upper section of the casing 2 and is provided with a laser emitting section (not shown), a rotatingly driven polygon mirror 19, lenses 20, 21, and reflection mirrors 22, 23, 24. The laser emitting section emits a laser beam based on desired image data. As indicated by single-dot chain line in FIG. 2, the laser beam passes through or is reflected by the mirror 19, the lens 20, the reflection mirrors 22 and 23, the lens 21, and the reflection mirror 24 in this order so as to irradiate, in a high speed scanning operation, the surface of the photosensitive drum 27 of the process unit 17.

The process unit 17 is disposed below the scanner section 16. The process unit 17 includes a drum cartridge 26 and a development cartridge 28. The drum cartridge 26 can be detached from the main casing 2 and houses the photosensitive drum 27, a scorotron charge unit 29, and a transfer roller 30.

Figure 3:
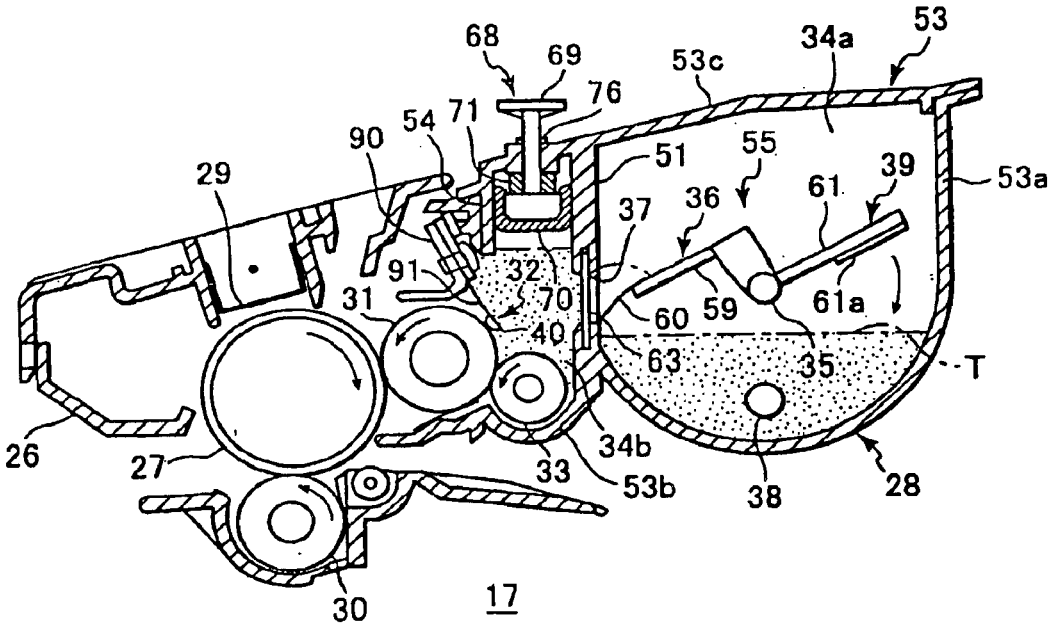
FIG. 3 is a cross-sectional view showing essential components of a process unit of the laser printer shown in FIG. 2.

The development cartridge 28 is detachable from the drum cartridge 26. As shown in FIG. 3, the development cartridge 28 has a casing 53 formed from a holding chamber wall 53*a*, a development chamber wall 53*b*, and a partition wall 51. The holding chamber wall 53*a* defines a holding chamber 34*a* and the development chamber wall 53*b* defines a development chamber 34*b*. The partition wall 51 is interposed between the holding chamber wall 53*a* and the development chamber wall 53*b*. A toner supply opening 37 is formed in the partition wall 51. As will be described later, the toner supply opening 37 includes a plurality of ribs that form slit shaped openings between the holding chamber 34*a* and the development chamber 34*b*.

An agitation member 55 is rotatably disposed in the holding chamber 34*a*. The toner chamber 34*a* is filled with positively charging, non-magnetic, single-component toner. In the present embodiment, polymerization toner is used as the toner. Polymerization toner has substantially spherical particles and so has an excellent fluidity characteristic. To produce polymerization toner, a polymerizing monomer is subjected to well-known polymerizing processes, such as suspension polymerization. Examples of a polymerizing monomer include a styrene type monomer or an acrylic type monomer. An example of a styrene type monomer is styrene. Examples of acrylic type monomers are acrylic acid, acrylic (C1–C4) acrylate, and acrylic (C1–C4) metaacrylate. Because the polymerization toner has such an excellent fluidity characteristic, image development is reliably performed so that high-quality images can be formed.

Materials such as wax and a coloring agent are distributed in the toner. The coloring agent can be carbon black, for example. In addition, two types of external additive are added in the toner to further improve the fluidity characteristic. One type of external additive has a weight-average particle diameter of 30 nm or less, and will be referred to as small-diameter external additive S, hereinafter. The weight-average particle diameter is determined by first determining the average weight of the particles. The diameter of an average weight particle is the weight-average particle diameter. The other type of external additive has a weight average particle diameter of 40 nm or greater, and will be referred to as large-diameter external additive L, hereinafter. The two types of external additive S, L are each added to the toner at rates of 0.5% to 1.5% by weight to achieve an external additive coverage rate of 70% or greater. As shown in Table 1, when the toner has an external additive coverage rate of 70% or greater, images are printed with a uniform image density from the first printed sheet. Here, a concrete example will be explained. In this example, the small-diameter external additive S has a BET surface area of 110 $m^2/g$ and a weight average particle diameter of 20 nm, and the large-diameter external additive L has a BET surface area of 40 $m^2/g$ and a weight average particle diameter of 40 nm. Toner including external additives S and L at these rates has a fluidity characteristic of 89 or greater.

Fluidity characteristic is a value measured using a powder tester PTR produced by the Hosokawa Micron Co., Ltd. The powder tester PTR includes three sieve levels. Each sieve level has a different mesh gauge. The first sieve level has a mesh gauge of 150 microns. The second sieve level has a mesh gauge of 75 microns. The third sieve level has a mesh gauge of 45 microns. To measure the fluidity characteristic, 4 g of toner is introduced into the tester PTR and applied with a fixed vibration for a fixed duration of time, such as 15 seconds. Afterward, the toner that remains in each sieve level is weighed and the fluidity calculated using the following equation:

$$\text{fluidity characteristic}=100-(X1+X2+X3),\ \text{wherein}$$

X1=weight of toner remaining on 1st sieve level/4 g×100;

X2=weight of toner remaining on 2nd sieve level/4 g×100×3/5; and

X3=weight of toner remaining on 3rd sieve level/4 g×100×1/5.

It should be noted that the fluidity characteristic tends to improve in association with increase in external additive coverage rate, as is known from the disclosure of "Collection of Papers presented at the 39th Symposium on Powder Science and Technology," pages 109 to 113.

Figure 5A:
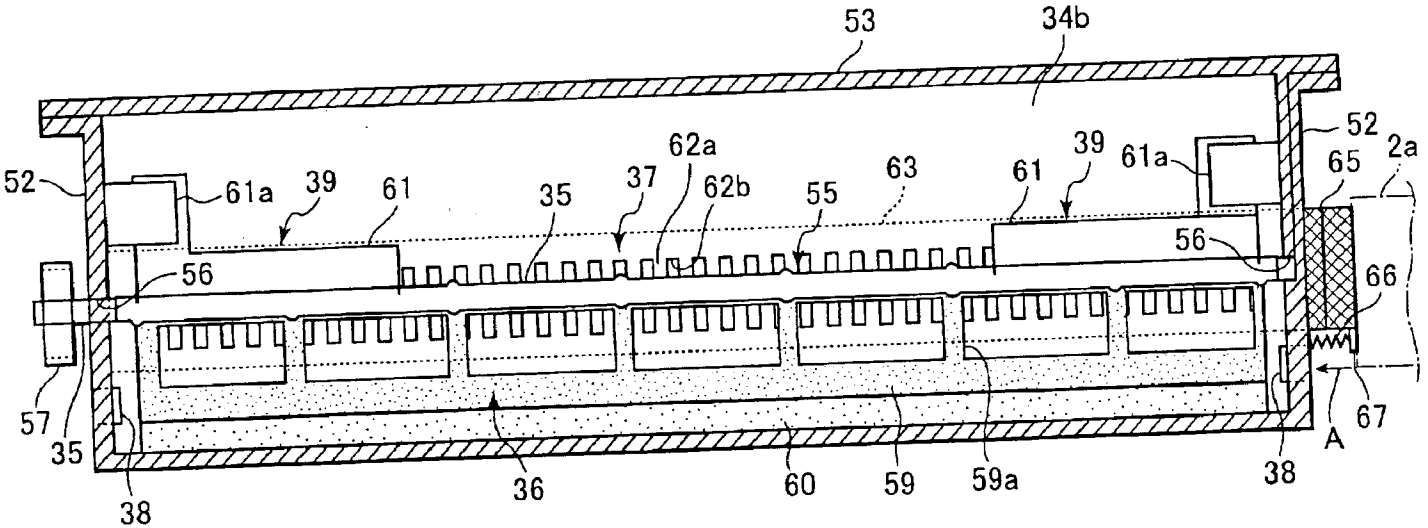
FIG. 5(*a*) is a cross-sectional view of the development cartridge as seen from the direction indicated by arrow M of FIGS. 4(*a*) and 4(*b*), showing the condition of the development cartridge while the development cartridge is mounted in the laser printer.
Figure 5B:
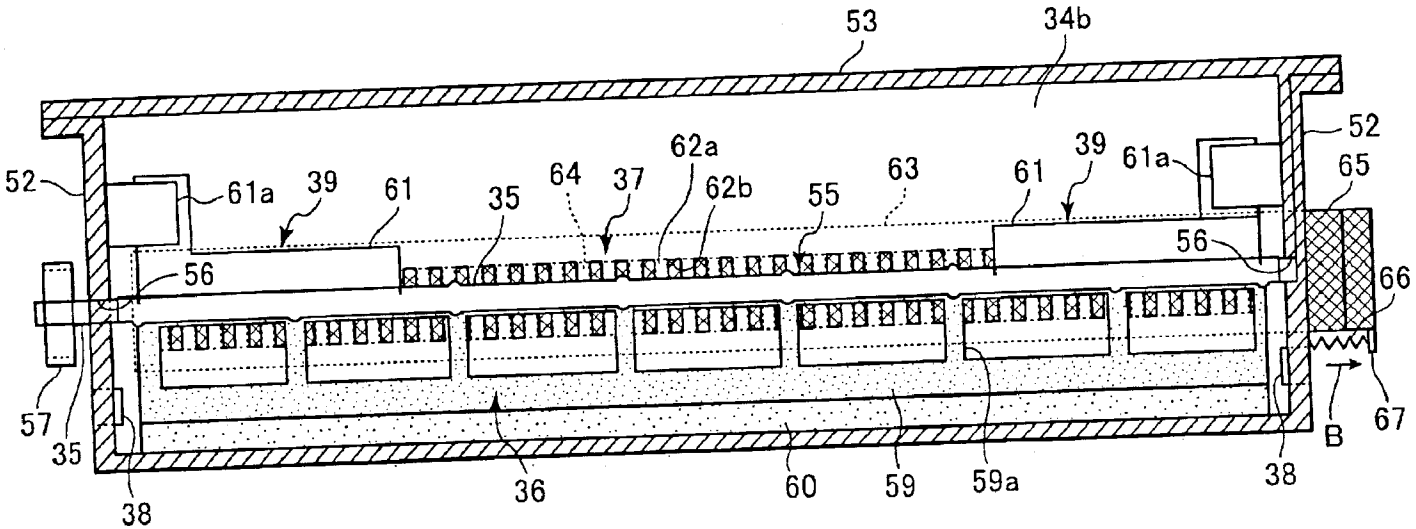

The agitator member 55 is disposed in the center of the holding chamber 34*a*. The agitator member 55 includes an agitator arm 36 and a cleaner arm 39 supported on a rotation shaft 35. When the agitator member 55 rotates in the clockwise direction as indicated by an arrow in FIG. 3, the agitator arm 36 agitates the toner in the holding chamber 34*a* and also conveys the toner through the toner supply opening 37 to the development chamber 34*b*. As shown in FIGS. 5(*a*) and 5(*a*), the casing 53 includes side walls 52 that define the lengthwise ends of the holding chamber 34*a*. Windows 38 (only one shown in FIG. 3) are formed in the side walls 52. The windows 38 are used to detect the amount of toner remaining in the holding chamber 34*a*. The cleaner arm 39 cleans the windows 38 as the agitator member 55 rotates.

Figure 4A:
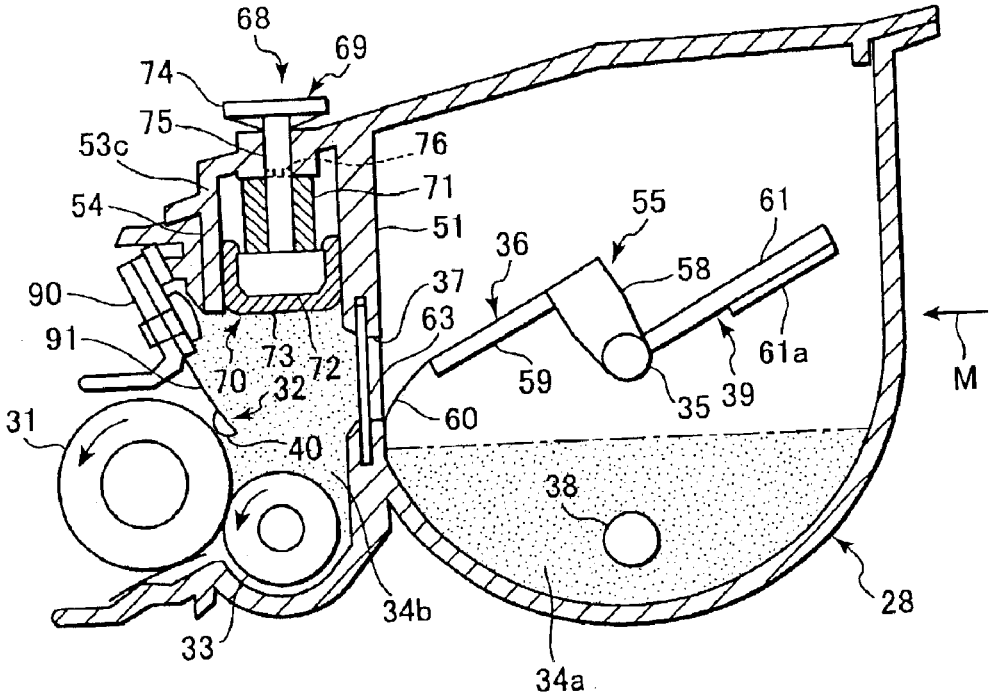
FIG. 4(*a*) is a cross-sectional view showing essential components of development cartridge of the process unit of FIG. 3, wherein a pressing member is in its lowered condition before the development cartridge is used.
Figure 4B:
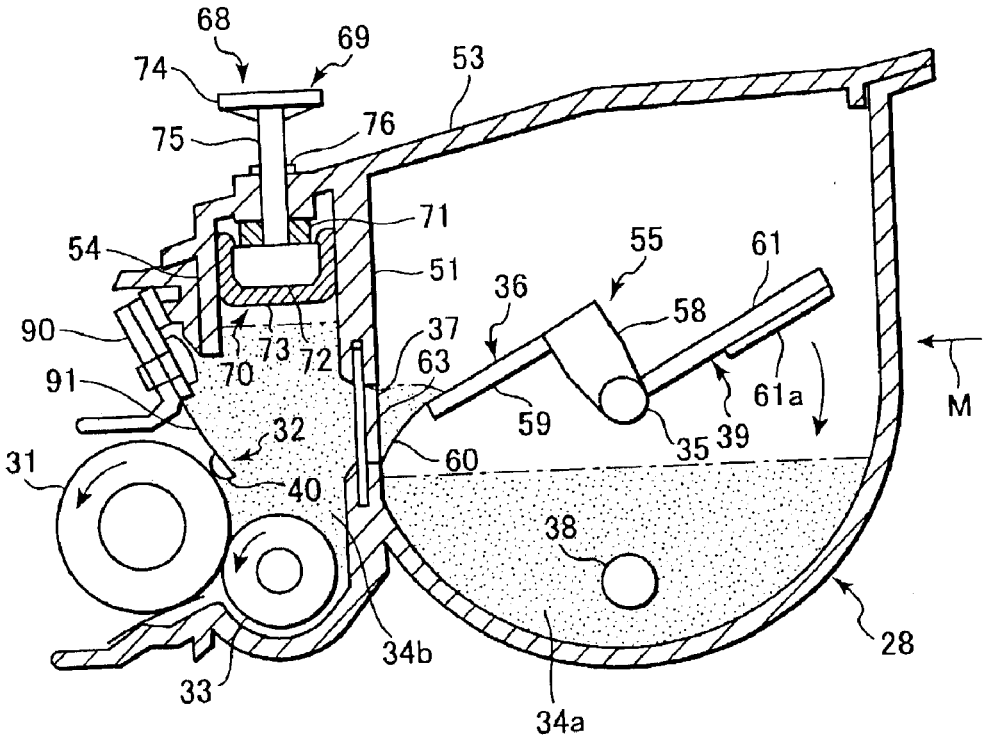

A developing roller 31, a layer thickness regulating blade 32, and a supply roller 33 are provided in the development chamber 34*b*. The supply roller 33 is disposed in the lower portion of the development chamber 34*b* at a position that is diagonally below the toner supply opening 37 with respect to the direction of the pull of gravity. The supply roller 33 is rotatable in the counterclockwise direction of FIG. 3 as indicated by an arrow. The supply roller 33 includes a metal roller shaft covered with a roller formed from an electrically conductive sponge material. The highest point of the supply roller 33 is separated from the inner ceiling of the development chamber 34*b* by 30 mm or more. As shown in FIG. 3, a pressing member 68 to be described later is disposed in the development chamber 34*b* at a position directly above the supply roller 33. As shown in FIGS. 4(*a*) and 4(*b*), the pressing member 68 includes a toner pressing portion 70 with a resilient cover 73. In the first embodiment, the inner ceiling of the development chamber 34*b* is the lower surface of the resilient cover 73 while the development cartridge 28 is in its normal operation condition shown in FIG. 4(*b*). The normal operation condition is the condition when the development cartridge 28 is developing images.

The developing roller 31 is disposed in the development chamber 34*b* to he side of the supply roller 33 in a direction substantially perpendicular to the direction of the pull of gravity. The developing roller 31 is located on the opposite side of the supply roller 33 than is the toner supply opening 37. The developing roller 31 is rotatable in the counterclockwise direction as indicated by an arrow in FIG. 3. The developing roller 31 includes a metal roller shaft and a roller portion covered thereon. The roller portion is made from a resilient member formed from a conductive rubber material. In more specific terms, the roller portion of the roller developing roller 31 is made from conductive silicone rubber or urethane rubber including, for example, carbon particles. The surface of the roller portion is covered with a coating layer of silicone rubber or urethane rubber that contains fluorine. The developing roller 31 is applied with a predetermined developing bias with respect to the photosensitive drum 27. The supply roller 33 and the developing roller 31 are disposed in abutment with each other so that both are compressed to a certain extent.

The layer thickness regulating blade 32 is disposed above the developing roller 31 so as to be in confrontation with the developing roller 31 following the axial direction of the developing roller 31. The layer thickness regulating blade 32 includes a support member 90, a spring member 91, and a pressing member 40. The support member 90 attaches the spring member 91 to the casing 53 of the development cartridge 28. The spring member 91 is formed from a metal spring member that extends downward from the support member 90 to the upper side of the developing roller 31. The pressing member 40 is provided on a free end of the spring member 91. The pressing member 40 has a semi-circular shape when viewed in cross section. The pressing member 40 is formed from silicone rubber with electrically insulating properties. The resilient force of the spring member 91 presses the pressing member 40 against the surface of the developing roller 31 from above.

The toner is transported and processed in the following manner as it is supplied from the holding chamber 34*a* to the developing roller 31. First, rotation of the agitator member 55 conveys toner from the holding chamber 34*a* through the toner supply opening 37 to the development chamber 34*b*. Then rotation of the supply roller 33 supplies the toner to the developing roller 31. At this time, the toner is triboelectrically charged to a positive charge between the supply roller 33 and the developing roller 31. Then, as the developing roller 31 rotates, the toner supplied onto the developing roller 31 moves between the developing roller 31 and the pressing member 40 of the layer thickness regulating blade 32. This reduces thickness of the toner on the surface of the developing roller 31 down to a thin layer of uniform thickness.

As shown in FIG. 3, the photosensitive drum 27 is disposed to the side of and in confrontation with the developing roller 31. The photosensitive drum 27 is rotatable in the clockwise direction as indicated by an arrow in FIG. 3. The photosensitive drum 27 includes a drum-shaped member and a surface layer. The drum-shaped member is connected to ground. The surface layer is formed on the drum-shaped member from a photosensitive layer that is made from polycarbonate and that has a positively charging nature.

The scorotron charge unit 29 is disposed above the photosensitive drum 27 and is spaced away from the photosensitive drum 27 by a predetermined space so as to avoid direct contact with the photosensitive drum 27. The scorotron charge unit 29 is positive-charge scorotron type charge unit for generating a corona discharge from a charge wire made from, for example, tungsten, to form a blanket of positive-polarity charge on the surface of the photosensitive drum 27.

The scorotron charge unit 29 forms a blanket of positive charge on the surface of the photosensitive drum 27 as the photosensitive drum 27 rotates. Then, the surface of the photosensitive drum 27 is exposed to high speed scan of the laser beam from the scanner section 16. The electric potential of the positively charged surface of the photosensitive drum 27 drops at positions exposed to the laser beam. As a result, an electrostatic latent image is formed on the photosensitive drum 27 based on desired image data used to drive the laser beam.

Next, an inverse developing process is performed. That is, as the developing roller 31 rotates, the positively-charged toner borne on the surface of the developing roller 31 is brought into contact with the photosensitive drum 27. At this time, the toner on the developing roller 31 is supplied to lower-potential areas of the electrostatic latent image on the photosensitive drum 27. As a result, the toner is selectively borne on the photosensitive drum 27 so that the electrostatic latent image is developed into a visible toner image.

The transfer roller 30 is rotatably supported in the drum cartridge 26 at a position below and in confrontation with the photosensitive drum 27. The transfer roller 30 is rotatable in the counterclockwise direction as indicated by an arrow in FIG. 3. The transfer roller 30 includes a metal roller shaft and a roller portion covering the shaft and made from electrically-conductive rubber material. At times of toner image transfer, the transfer roller 30 is applied with a predetermined transfer bias with respect to the photosensitive drum 27. For this reason, the visible toner image borne on the surface of the photosensitive drum 27 is transferred to a sheet 3 as the sheet 3 passes between the photosensitive drum 27 and the transfer roller 30.

The fixing section 18 is disposed downstream from the process unit 17 and includes a thermal roller 41, a pressing roller 42, and transport rollers 43. The pressing roller 42 presses against the thermal roller 41. The transport rollers 43 are provided downstream from the thermal roller 41 and the pressing roller 42. The thermal roller 41 includes a metal tube and a halogen lamp disposed therein. The halogen lamp heats up the metal tube so that toner that was transferred onto sheets 3 in the process unit 17 is thermally fixed onto the sheets 3 as the sheet 3 passes between the thermal roller 41 and the pressing roller 42. Afterward, the sheet 3 is transported to a sheet-discharge path 44 by the transport rollers 43 and discharged onto a sheet-discharge tray 46 by sheet-discharge rollers 45.

The laser printer 1 is provided with an inverting transport unit 47 for inverting sheets 3 that have been printed on once and returning the sheets 3 to the image forming unit 5 so that images can be formed on both sides of the sheets 3. The inverting transport unit 47 includes the sheet-discharge rollers 45, an inversion transport path 48, a flapper 49, and a plurality of inversion transport rollers 50.

The sheet-discharge rollers 45 are a pair of rollers that can be rotated selectively forward or in reverse. The sheet-discharge rollers 45 are rotated forward to discharge sheets 3 onto the sheet-discharge tray 46 and rotated in reverse when sheets are to be inverted.

The inversion transport rollers 50 are disposed below the image forming unit 5. The inversion transport path 48 extends vertically between the sheet-discharge rollers 45 and the inversion transport rollers 50. The upstream end of the inversion transport path 48 is located near the sheet-discharge rollers 45 and the downstream end is located near the inversion transport rollers 50 so that sheets 3 can be transported downward from the sheet-discharge rollers 45 to the inversion transport rollers 50.

The flapper 49 is swingably disposed at the junction between the sheet-discharge path 44 and the inversion transport path 48. By activating or deactivating a solenoid (not shown), the flapper 49 can be selectively swung between the orientation shown in broken line in FIG. 2 and the orientation shown by solid line in FIG. 2. The orientation shown in solid line in FIG. 2 is for transporting sheets 3 that have one side printed to the sheet-discharge rollers 45. The orientation shown in broken line in FIG. 2 is for transporting sheets from the sheet-discharge rollers 45 into the inversion transport path 48, rather than back into the sheet-discharge path 44.

The inversion transport rollers 50 are aligned horizontally at positions above the sheet supply tray 6. The pair of inversion transport rollers 50 that is farthest upstream is disposed near the rear end of the inversion transport path 48. The pair of inversion transport rollers 50 that is located farthest downstream is disposed below the registration rollers 12.

The inverting transport unit 47 operates in the following manner when a sheet 3 is to be formed with images on both sides. A sheet 3 that has been formed on one side with an image is transported by the transport rollers 43 from the sheet-discharge path 44 to the sheet-discharge rollers 45. The sheet-discharge rollers 45 rotate forward with the sheet 3 pinched therebetween until almost all of the sheet 3 is transported out from the laser printer 1 and over the sheet-discharge tray 46. The forward rotation of the sheet-discharge rollers 45 is stopped once the rear-side end of the sheet 3 is located between the sheet-discharge rollers 45.

Then, the sheet-discharge rollers 45 are driven to rotate in reverse while at the same time the flapper 49 is switched to change transport direction of the sheet 3 toward the inversion transport path 48. As a result, the sheet 3 is transported into the inversion transport path 48. The flapper 49 reverts to its initial position once transport of the sheet 3 to the inversion transport path 48 is completed. That is, the flapper 49 switches back to the position for transporting sheets from the transport rollers 43 to the sheet-discharge rollers 45. Next, the inverted sheet 3 is transported through the inversion transport path 48 to the inversion transport rollers 50 and then upward from the inversion transport rollers 50 to the registration rollers 12. The registration rollers 12 align the front edge of the sheet 3. Afterward, the sheet 3 is transported toward the image formation position. At this time, the upper and lower surfaces of the sheet 3 are reversed from the first time that an image was formed on the sheet 3 so that an image can be formed on the other side as well. In this way, images are formed on both sides of the sheet 3.

The laser printer 1 uses the developing roller 31 to collect residual toner that remains on the surface of the photosensitive drum 27 after toner is transferred onto the sheet 3 via the transfer roller 30. In other words, the laser printer 1 uses a "cleanerless development method" to collect the residual toner. By using the cleanerless development method to collect residual toner, there is no need to provide a separate member, such as a blade, for removing the residual toner or an accumulation tank for holding the waste toner. Therefore, the configuration of the laser printer can be simplified, and size and manufacturing costs of the laser printer 1 can be reduced.

The toner supply opening 37 of the development cartridge 28 is located below the lower end of the partition wall 51. As shown in FIG. 5(*a*), slats 62*a* or grids extend vertically across the toner supply opening 37. The slats 62*a* are aligned in the horizontal direction of toner supply opening 37, separated from each other by a predetermined distance, thereby defining therebetween vertically elongated slits 62*b*. The slits 62*b* all have substantially that same rectangular shape, with a height equal to the vertical length of the slats 62*a* and a width equal to the distance between adjacent slats 62*a*.

Figure 6A:
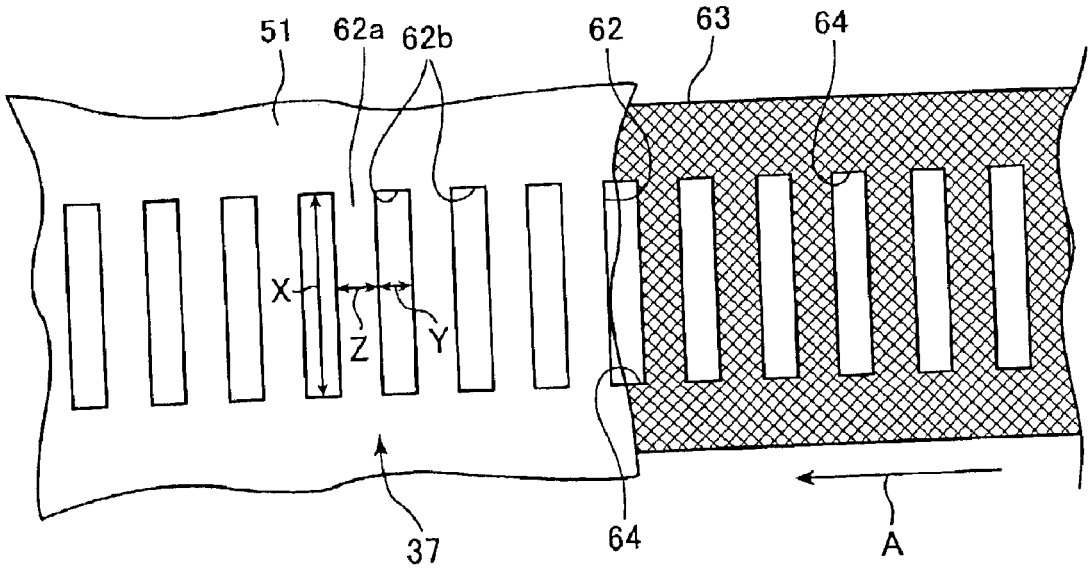
FIG. 6(*a*) is a magnified view of FIG. 5(*a*), showing toner supply slits aligned with shutter openings of a shutter member in the development cartridge, so that toner can pass through the toner supply slits.
Figure 6B:
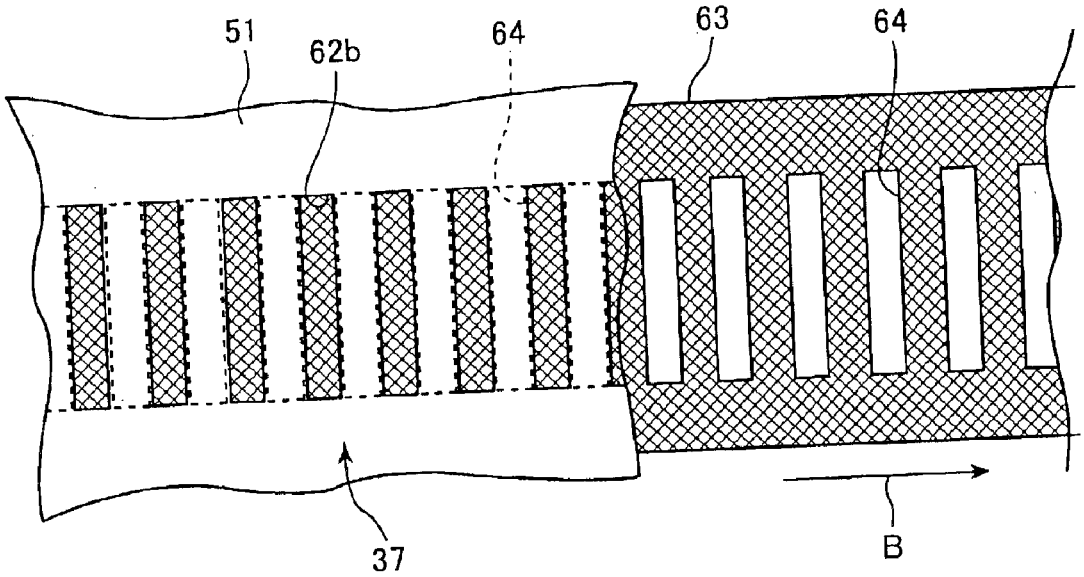

As shown in greater detail in FIGS. 6(*a*) and 6(*b*), the slats 62*a* have a horizontal width Z of about 1.5 mm and adjacent slats 62*a* are separated from each other by a distance Y of about 1 mm. Said differently, the slits 62*b* have a horizontal width Y of about 1 mm and adjacent slits 62*b* are separated from each other by the width Z of about 1.5 mm. The slits 62*b* have a vertical length X of about 10 mm to 15 mm.

The toner supply opening 37 is formed with a width in the horizontal direction that is substantially the same as the width of the image forming region of the photosensitive drum 27, that is, the width (in the axial direction of the photosensitive drum 27) of the region on the photosensitive drum 27 where electrostatic latent images are formed.

As shown in FIG. 3, a shutter member 63 is provided in the partition wall 51.

As shown in FIGS. 5(*a*) and 5(*a*), the shutter member 63 has a substantially elongated rectangular shape. The shutter member 63 is disposed in the development chamber 34*b* at a position adjacent to the partition wall 51 and in confrontation with the toner supply opening 37. As a result, the shutter member 63 covers the toner supply opening 37. As shown in FIGS. 6(*a*) and 6(*b*), the shutter member 63 is formed with shutter openings 64 in the same number as the slits 62*b* at the toner supply opening 37. The shutter openings 64 also have substantially the same shape and spacing as the slits 62*b*. As shown in FIGS. 5(*a*) and (*b*), one widthwise end of the shutter member 63 forms an external protrusion 65 which protrudes out from the holding chamber 34*a* through the side walls 52. A holding member 67 is provided integrally on the end of the external protrusion 65. The holding member 67 protrudes downward. A spring 66 is interposed between the side wall 52 and the holding member 67. The spring 66 constantly urges the holding member 67 to protrude out from the side wall 52.

When the development cartridge 28 is removed from the laser printer 1, as shown in FIG. 5(*b*) the urging force of the spring 66 shifts the shutter member 63 in the development cartridge 28 in the direction indicated by an arrow B, that is, to the right as viewed in FIG. 5(*b*), and maintains the shutter member 63 in this condition. While the shutter member 63 is shifted in this manner, as shown in FIG. 6(*b*) the solid portions of the shutter member 63 between the shutter openings 64 overlap with the slits 62*b* in the toner supply opening 37 so that the shutter member 63 blocks the slits 62*b*. As a result, fluid communication between the holding chamber 34*a* and the development chamber 34*b* is blocked while the development cartridge 28 is not mounted in the laser printer 1.

On the other hand, as shown in FIG. 5(*a*), when the development cartridge 28 is mounted into the laser printer 1, an abutment member 2*a* provided on the main casing 2 abuts against the external protrusion 65 so that the external protrusion 65 is pressed in against the urging force of the spring 66. As a result, the shutter member 63 shifts in the direction indicated by an arrow A, that is, to the left as viewed in FIG. 5(*a*), and is maintained there by the presence of the abutment member 2*a*. In this condition, as shown in FIG. 6(*a*), the shutter openings 64 overlap with the slits 62*b* so that toner can pass through the slits 62*b* from the holding chamber 34*a* to the development chamber 34*b* while the development cartridge 28 is mounted in the laser printer 1.

As described previously with reference to FIGS. 4(*a*) and 4(*b*), the agitator member 55 of the development cartridge 28 is disposed in the substantial center of the holding chamber 34*a* and includes the rotation shaft 35, the agitator arm 36, and the cleaner arm 39.

As shown in FIGS. 5(*a*) and 5(*a*), the ends of the rotation shaft 35 are inserted through support holes 56 formed in the substantial center of the side walls 52 of the holding chamber 34*a*. One end of the rotation shaft 35 protrudes outside from the holding chamber 34*a*. A gear 57 is fixedly mounted to an end of the rotation shaft 35 that protrudes out from the holding chamber 34*a*. Drive force from a power source (not shown) is transmitted to the gear 57 so that the rotation shaft 35 can be rotated in the holding chamber 34*a*.

As shown in FIGS. 4(*a*) and 4(*b*), the agitator arm 36 includes a base 58, a transport plate 59, and a film member 60. The base 58 has a substantially rectangular shape in cross section and is provided across the entire axial length of the rotation shaft 35 in the holding chamber 34*a*. The transport plate 59 is provided on free end of the base 58. The transport plate 59 is also shown in FIGS. 5(*a*) and 5(*b*). The film member 60 is adhered to the free end of the transport plate 59 following the axial length of the rotation shaft 35.

The transport plate 59 has a length in the axial direction of the rotation shaft 35 that is substantially the same as the width of the image forming region of the photosensitive drum 27, that is, the length in the axial direction of the photosensitive drum 27 of the region of the photosensitive drum 27 where electrostatic latent images are formed. As shown in FIGS. 5(*a*) and 5(*b*), the transport plate 59 is formed with substantially rectangular openings 59*a* for reducing resistance to toner while the agitator member 55 is being rotated to agitate the toner. The openings 59*a* are formed in the transport plate 59 at the side nearer the base 58 and are separated from each other in the axial direction of the rotation shaft 35 by a predetermined spacing.

The film member 60 is made from polyethylene terephthalate (PET), for example. The film member 60 is adhered to the front surface, with respect to the rotation direction of the agitator member 55, of the free end of the transport plate 59 and follows the axial length of the agitator member 55.

As the rotation shaft 35 rotates, the free end of the film member 60 first rubs against the lower internal surface of the holding chamber 34*a* and then rubs across the entire toner supply opening 37 in the partition wall 51 with a predetermined pressing force. At this time, the film member 60 scrapes up toner from the base of the holding chamber 34*a* and pushes the toner toward the development chamber 34*b* through the slits 62*b*. When a predetermined amount (to be described later) of toner fills the development chamber 34*b*, then the pressure of toner in the development chamber 34*b* will be substantially the same as the pressing force generated by the film member 60 that pushes the toner through the slits 62*b*.

As described above, the agitator arm 36 is formed substantially uniform in shape along its entire width, that is, in the axial direction of the agitator member 55. Therefore, the agitator arm 36 conveys the toner to the development chamber 34*b* with substantially equal force along its entire width. As a result, the agitator arm 36 transports the toner in the holding chamber 34*a* through the slits 62*b* and into the development chamber 34*b* in a substantially equivalent manner along its entire width.

As shown in FIGS. 5(*a*) and 5(*b*), the cleaner arm 39 includes plate-shaped members 61 and cleaning members 61*a*. As seen in FIGS. 4(*a*) and 4(*b*), the plate-shaped members 61 extend in the opposite direction that the transport plate 59 extends. As shown in FIGS. 5(*a*) and 5(*b*), the plate-shaped members 61 each have two sections forming a substantial L-shape. The first section is formed following the rotation shaft 35. The second section of the L-shape is formed in confrontation with the side wall so as to extend perpendicular to the first section. Each cleaning member 61*a* is formed from a resilient material in a substantially rectangular plate shape. Each cleaning member 61*a* is adhered on the second section of the plate-shaped member 61 at a position adjacent to the corresponding side wall 52 so the cleaning member 61*a* can wipe off the windows 38 from inside the holding chamber 34*a*.

As shown in FIGS. 4(*a*) and 4(*b*), a pressing member 68 is provided in the development chamber 34*b*. The pressing member 68 is for pressing toner in the development chamber 34*b* down toward the supply roller 33. The pressing member 68 is provided in an upper portion 53*c* of the casing 53 and includes a knob 69, a toner pressing portion 70, and a urging sponge member 71.

The knob 69 includes a plate-shaped grip portion 74 and a shaft 75. The shaft 75 extends downward from the center of the grip portion 74 so that the knob 69 has a substantial T-shape in cross section. The shaft 75 penetrates vertically downward through the upper portion 53*c* of the casing 53. A lock member 76 is mounted in the shaft 75 at a position midway along the shaft 75. Although not shown in the drawings, a resilient member is provided in the shaft 75 for urging the lock member 76 to partially protrude radially outward from the shaft 75 as shown in FIG. 4(*b*).

The toner pressing portion 70 is fitted in a space encompassed in the upper portion of the development chamber 34*b* by the side walls 52, the partition wall 51, and a front wall 54 shown in FIG. 4(*a*). The toner pressing portion 70 includes a pressing member 72 and the resilient cover 73. The pressing member 72 is provided integrally with the lower end of the shaft 75. The resilient cover 73 is made from a resilient material that covers the sides and lower end of the pressing member 72. The pressing member 72 is fitted with a tight seal in the space encompassed by the side walls 52, the partition wall 51, and the front wall 54.

The urging sponge member 71 is formed from a sponge material and is mounted around the outer periphery of the shaft 75. The urging sponge member 71 is interposed in a compressed condition between the upper surface of the pressing member 72 and the lower surface of the upper portion 53*c* of the casing 53.

The pressing member 68 is in the condition shown in FIG. 4(*a*) before the development cartridge 28 is used. In this condition, the resilient force of the urging sponge member 71 presses the toner pressing portion 70 downward so that the toner pressing portion 70 presses the toner in the development chamber 34*b* toward the supply roller 33. At this time, the inner peripheral surface of the upper portion 53*c* prevents the lock member 76 from protruding outward, so the lock member 76 is retained inside the shaft 75.

The knob 69 is raised upward during the normal operation condition of the development cartridge 28, that is, during image formation. As a result, the urging sponge member 71 is compressed and the toner pressing portion 70 moves closer to the upper portion 53*c* of the casing 53. This releases the pressure developed against the supply roller 33 by the toner pressing portion 70. Also, the knob 69 moves upward so that the lock member 76 is positioned above the upper portion 53*c* of the casing 53 and released from restriction by the upper portion 53*c*. Therefore, the resilient force of the resilient member (not shown) in the shaft 75 projects the lock member 76 radially outward. As a result, the knob 69 is prevented from moving downward.

Next, will be described a series of operations performed up to when the development cartridge 28 is mounted in the laser printer 1 and brought into its normal operation condition for forming images.

The development cartridge 28 is prepared in the following manner before shipment from the factory. First, the holding chamber 34*a* of the development cartridge 28 is filled with new toner. Then, the development chamber 34*b* is filled with the new toner. Because the development chamber 34*b* is filled up before shipment, image formation can be performed properly from the first sheet 3 immediately after the user mounts the development cartridge 28 in the laser printer 1 and records images.

The process of filling the development chamber 34*b* with new toner will be described. While the knob 69 of the pressing member 68 is raised up as shown in FIG. 4(*b*), the external protrusion 65 of the shutter member 63 is pressed toward the inside of the development cartridge 28 so that the shutter member 63 shifts in the direction of arrow A in FIG. 5(*a*) into the development cartridge 28. As a result, the slits 62*b* in the toner supply opening 37 and the shutter openings 64 in the shutter openings 64 fall into alignment with each other as shown in FIGS. 5(*a*) and 6(*a*). Therefore, the holding chamber 34*a* and the development chamber 34*b* are brought into fluid communication through slit shaped openings.

Next, a motor (not shown) is connected to the gear 57 of the rotation shaft 35 and driven to rotate the agitator member 55. As a result, the agitator arm 36 conveys toner from the holding chamber 34*a* through the slits 62*b* and into the development chamber 34*b*. This is continued until the upper surface of toner (toner level) in the development chamber 34*b* is near the lower surface of the resilient cover 73 of the toner pressing portion 70. Once this level of toner is reached, the motor is stopped to stop rotation of the agitator arm 36. Then, the external protrusion 65 of the shutter member 63 is released so that the urging force of the spring 66 shifts the shutter member 63 in the direction of arrow B back into the position indicated in FIGS. 5(*a*) and 6(*b*), wherein the slits 62*b* in the toner supply opening 37 and the shutter openings 64 in the shutter openings 64 are shifted out of alignment with each other so that the toner supply opening 37 between the holding chamber 34*a* and the development chamber 34*b* is blocked shut.

Next, the knob 69 of the pressing member 68 is lowered down. As a result, the lock member 76 retracts back into the shaft 75 and the resilient force of the urging sponge member 71 pushes the toner pressing portion 70 downward so that the toner pressing portion 70 presses the toner in the development chamber 34*b* toward the supply roller 33. From these processes, the development chamber 34*b* is filled with a sufficient amount of toner when the development cartridge 28 is shipped from the factory. Further, the toner in the development chamber 34*b* is pressed against the supply roller 33 by the pressing member 68.

Because the pressing member 68 presses the toner in the development chamber 34*b* against the supply roller 33, the toner in the development chamber 34*b* has a higher density than the sifted apparent density of the toner. In more concrete terms, the development chamber 34*b* is filled with 2 g or more of toner for every 1 cm of the axial length of the supply roller 33. Also, the toner fills the development chamber 34*b* to a height of 25 mm or more above the upper edge of the supply roller 33.

The sifted apparent density of the toner refers to the density of the toner directly after it has been sifted through a sifter. The sifted apparent density of the toner in the present embodiment is 0.4 g/ml. The sifted apparent density can be measured using a powder tester manufactured by Hosokawa Micron Co., Ltd.

The user receives the development cartridge 28 with toner filling the development chamber 34*b* in this manner. Before mounting the development cartridge 28 in the laser printer 1 for the first time, the user pulls the pressing member 68 upward to retract the toner pressing portion 70 away from the toner on the supply roller 33, while compressing the urging sponge member 71. When the toner pressing portion 70 is retracted in this manner, the pressing force of the toner pressing portion 70 is released from the toner, so that the pressure against the supply roller 33 is released to a certain extent.

Next, the user mounts the development cartridge 28 into the laser printer 1 for the first time. When the development cartridge 28 is mounted in the laser printer 1, the abutment member 2*a* of the main casing 2 abuts against the external protrusion 65 so that the external protrusion 65 is pressed in against the urging force of the spring 66. As a result, once the development cartridge 28 is mounted in the laser printer 1, the slits 62*b* and the shutter openings 64 are aligned with each other as shown in FIGS. 5(*a*) and 6(*a*) so that the holding chamber 34*a* and the development chamber 34*b* are brought into fluid communication with each other. Next the laser printer 1 is started up and image formation begun.

As described above, before the development cartridge 28 is mounted in the laser printer 1, the shutter member 63 prevents toner from passing between the holding chamber 34*a* and the development chamber 34*b*. Also, before the development cartridge 28 is mounted in the laser printer 1, the toner in the development chamber 34*b* is compressed to a density that is greater than the sifted apparent density of the toner. In the present embodiment, the toner in the development chamber 34*b* has a density of 2 g or more per 1 cm in the axial direction of the developing roller 31. Therefore, enough toner will fill the development chamber 34*b* from the very start of image formation. Directly after image formation starts, toner will descend toward the developing roller 31 by its own weight so that sufficient toner is supplied to the developing roller 31. Thus, images can be formed with an appropriate image density from the very start of image formation.

Also, the pressing member 68 maintains pressure against the toner in the development chamber 34*b* toward the supply roller 33 until the development cartridge 28 is mounted in the laser printer 1 and used the first time. Therefore, the toner properly presses on the supply roller 33 from the very start of image formation. Therefore, a proper amount of toner is supplied to the developing roller 31 directly after developing operations start so that images can be formed with an appropriate image density.

As described previously, before the development cartridge 28 is mounted into the laser printer 1, the knob 69 of the pressing member 68 is raised upward so that the pressure exerted by the toner pressing portion 70 on the toner is released. Therefore, the toner can freely flow within the development chamber 34*b* so that rotation of the developing roller 31 and the supply roller 33 can properly circulate the toner within the development chamber 34*b* after the development cartridge 28 is mounted in the laser printer 1. This insures stabilized charging to the toner, so that even better images can be formed.

Even before the development cartridge 28 is used for developing images a first time, the development chamber 34*b* is filled with toner to a height of 25 mm or more above the upper edge of the supply roller 33. This depth of toner above the supply roller 33 presses down on the supply roller 33 by its own weight. Therefore, the toner is reliably supplied to the supply roller 33, so that the supply roller 33 reliably supplies the toner to the developing roller 31. This insures that the developing roller 31 will always bear the proper amount of toner and that images will be formed with the proper image density.

As described previously, the shutter member 63 can selectively open and close the toner supply opening 37. Because the shutter member 63 closes off the toner supply opening 37 before the development cartridge 28 is used, the proper amount of toner can be maintained in the development chamber 34*b*. Also, because the shutter member 63 can be manipulated to open up the toner supply opening 37 when the development cartridge 28 is to be used, toner can be supplied from the holding chamber 34*a,* through the toner supply opening 37, and into the development chamber 34*b.* This simple configuration ensures that toner properly fills the development chamber 34*b* before the development cartridge 28 is used and that toner is properly supplied from the holding chamber 34*a* to the development chamber 34*b* after the development cartridge 28 is mounted into the laser printer 1.

Once the laser printer 1 is started up and image formation begun, the agitator member 55 is driven to rotate so that the agitator arm 36 begins to convey toner from the holding chamber 34*a,* through the toner supply opening 37, and into the development chamber 34*b.* At this time, the toner passes through the slits 62*b* of the toner supply opening 37. In other words, the slits 62*b* enable toner to pass from the holding chamber 34*a* to the development chamber 34*b.* On the other hand, the slats 62*a,* in combination with the narrow slit shape of the slits 62*b,* restrict flow of toner in the opposite direction, that is, from the development chamber 34*b* back into the holding chamber 34*a.* For this reason, a predetermined amount of toner can be maintained in the development chamber 34*b* during image formation, regardless of the amount of toner in the holding chamber 34*a.*

The pressure in the toner in the development chamber 34*b* gradually increases as the agitator arm 36 presses more and more toner into the development chamber 34*b.* The pressure in the toner of the development chamber 34*b* will peak once it is substantially the same as the pressing force at which the film member 60 of the agitator arm 36 presses the toner through the toner supply opening 37. That is, once a predetermined amount of toner fills the development chamber 34*b,* the film member 60 will not be capable of pressing any more toner into the development chamber 34*b* because the pressure in the toner will be substantially the same as the pressing force of the film member 60. In this way, the amount of toner that is conveyed into the development chamber 34*b* is limited.

During the normal operation condition of image formation, the slats 62*a* maintain toner in the development chamber 34*b* to a level above the position where the agitator arm 36 presses toner through the toner supply opening 37. In the present embodiment, the slats 62*a* maintain toner in the development chamber 34*b* to a height of 25 mm or more above the upper edge of the supply roller 33. On the other hand, the slits 62*b* insure that during the normal operation condition a space of about 3 mm to 10 mm is opened between the upper surface of the toner (toner level) and the ceiling of the development chamber 34*b.* In the present embodiment, the ceiling of the development chamber 34*b* is the lower surface of the resilient cover 73 of the toner pressing portion 70. Further, during the normal operation condition, the agitator arm 36 fills the development chamber 34*b* with 2 g or more of toner per 1 cm in the axial direction of the developing roller 31 and increases the density of the toner in the development chamber 34*b* to greater than the sifted apparent density of the toner. In the present embodiment, the toner near the supply roller 33 has a density of 1.5 times as large as the sifted apparent density of the toner.

As a result, a sufficient amount of toner will fill the development chamber 34*b* during the normal operation condition, even though the amount of toner in the holding chamber 34*a* is reduced through image formation. Because sufficient toner fills the development chamber 34*b,* the weight of the toner presses the toner firmly against the supply roller 33, so that a proper amount of toner will always be supported on the supply roller 33. Consequently, the supply roller 33 will always supply a proper amount of toner to the developing roller 31 so that the developing roller 31 will always bear the proper amount of toner. As a result, the laser printer will form images with a properly high density, even after being left unused for long periods of time. Also, toner is immediately transported to the development chamber 34*b* when printing is first performed. Therefore, high density images will be formed even the first time printing is performed.

The different types of external additive S, L can cause problems when toner fills the development chamber 34*b* at a high density. For example, the large-diameter external additive L (with a large weight average particle diameter) can snag on surrounding particles when toner density is high. This reduces the ease at which the toner particles can move, which translates into a reduction in the fluidity characteristic of the toner. The small-diameter external additive S (with a small weight average particle diameter) gives the toner an excessively high fluidity characteristic when the toner density is high, so that the amount of toner supplied by the supply roller 33 to the developing roller 31 can fluctuate unstably.

According to the present embodiment, the small-diameter external additive S has a weight-average particle diameter of 20 nm or less and the large-diameter external additive L has a weight average particle diameter of 40 nm or greater. The two types of external additive S, L are each added to the toner at rates of 0.5% to 1.5% by weight to achieve an external additive coverage rate of 70% or greater. This imparts the toner filling the development chamber 34*b* with a fluidity characteristic of 89 or greater. Therefore, toner can be stably supplied from the supply roller 33 to the developing roller 31. Accordingly, the developing roller 31 will consistently bear a uniform amount of toner per unit surface area of the developing roller 31. Therefore, the development cartridge 28 will develop images at a consistent toner density even at the start of printing. Therefore the density of images formed on the sheets 3 will be consistent.

Once a predetermined amount of toner fills the development chamber 34*b,* the toner will press against the toner supply opening 37 with a force equivalent to the pressing force of the agitator arm 36 against the toner supply opening 37. Therefore, once the predetermined amount of toner fills the development chamber 34*b,* then the agitator arm 36 will not be able to transport any further toner from the holding chamber 34*a* into the development chamber 34*b.* On the other hand, the agitator arm 36 will continue to force more toner into the development chamber 34*b* until the predetermined amount of toner fills the development chamber 34*b.* As a result, the predetermined amount of toner can be constantly maintained in the development chamber 34*b.* Therefore, the supply roller 33 will supply a constant amount of toner to the developing roller 31, and the developing roller will bear the proper amount of toner, regardless of how much toner fills the holding chamber 34*a.* Therefore, the density of images can be stably maintained.

If toner is filled in the development chamber 34*b* to such a degree where no space existed between the upper surface of the toner and the ceiling of the development chamber 34*b,* then the toner would circulate poorly, so the charge would not be uniform throughout the toner filling the development chamber 34*b.* However, in the present embodiment, a space is maintained between the upper surface of the toner and the ceiling of the development chamber 34*b.* Therefore, the toner in the development chamber 34*b* circulates properly so that all of the toner in the development chamber 34*b* is uniformly charged. Thus, good images can be formed.

As mentioned previously, the highest point of the supply roller 33 is separated from the lower surface of the resilient cover 73 of the toner pressing portion 70 by a distance of 30 mm or more. Therefore, a sufficient amount of toner can be maintained in the development chamber 34*b* even if a space is opened between the toner and the lower surface of the resilient cover 73. Therefore, the toner can be properly circulated and also properly supplied to the developing roller 31. As a result, uniformity of image density can be enhanced even further.

Further, sufficient toner will fill the development chamber 34*b* because the development chamber 34*b* is filled with 2 g or more of toner per each centimeter in the axial direction of the supply roller 33. For this reason, the developing roller 31 will bear a sufficient amount of toner. As a result, uniformity of image density can be enhanced even further.

As described previously, the toner supply opening 37 and the agitator arm 36 have each width in the horizontal direction that is substantially the same as the width of the image forming region of the photosensitive drum 27. This insures that toner is supplied to the developing roller 31 (from the holding chamber 34*a* through the toner supply opening 37) in desired amounts, so that good images can be formed. In other words, in the illustrated embodiment, because of the provision of the slats or grids 62*a*, toner returning from the development chamber 34*b* to the holding chamber 34*a* can be restricted. Therefore, the width of the toner supply opening 37 can be made equal to the width of the image forming region. If such slats 62*a* are not provided at the opening 37, the toner returning from the development chamber 34*b* to the holding chamber 34*a* may be accelerated. To avoid this problem, width of the toner supply opening 37 must be smaller than the width of the image forming region. In the latter case, toner stagnation may occur at local areas of the image forming region not facing with the opening 37. In the present embodiment, in contrast, such toner stagnation does not occur because width of the opening can be equal to the width of the image forming region because of the provision of the slats. Thus, image development can be properly performed.

The agitator arm 36 is produced to provide substantially the same toner-transporting force along its entire length following the axial direction of the developing roller 31. Therefore, the agitator arm 36 will supply toner into the development chamber 34*b* uniformly across the entire width of the toner supply opening 37. This insures that the developing roller 31 will bear the same amount of toner along its entire axial length. As a result, images will be formed with consistent toner density.

Also, the supply roller 33 and the developing roller 31 are disposed in pressing contact with each other in the development cartridge 28. Therefore, the supply roller 33 supplies a sufficient amount of toner to the developing roller 31. Also, the toner supplied to the developing roller 31 is triboelectrically charged between the supply roller 33 and the developing roller 31 to a sufficiently high charge. Therefore, toner that is sufficiently charged can be reliably supplied to the developing roller 31.

Also, the supply roller 33 is disposed in the lower section of the development chamber 34*b* at a position below the toner, that is, with respect to the direction of gravitational force of the toner, and below where the agitator arm 36 conveys toner into the development chamber 34*b*. With this configuration, the toner is transported into the development chamber 34*b* at a position above the supply roller 33 so that the weight of the toner presses down on the supply roller 33. As a result, the toner is reliably supplied to the supply roller 33 so that the supply roller 33 reliably supplies toner to the developing roller 31. Accordingly, images will be consistently formed with the appropriate toner density.

The developing roller 31 is positioned to the side of the supply roller 33 in a direction that is perpendicular to the direction of gravitational force that acts on the toner in the development chamber 34*b*. Further, the spring member 91 of the layer thickness regulating blade 32 is positioned above the developing roller 31 so that the toner in the development chamber 34*b* cannot press directly down on the developing roller 31.

If the spring member 91 did not separate the toner from the developing roller 31, then the weight of the toner in the development chamber 34*b* pressed directly on the developing roller 31. In this case, the toner would be supplied directly to the developing roller 31 without being charged between the supply roller 33 and the developing roller 31. As a result, the toner would have variable and inconsistent charge.

However, the configuration of the present embodiment restricts the toner weight that presses directly on the developing roller 31, because the developing roller 31 is positioned to the side of the supply roller 33 and the spring member 91 is interposed between the toner and the developing roller 31. As a result, less of the toner weight presses directly on the developing roller 31 so that toner is charged between the supply roller 33 and the developing roller 31 before being supplied to the developing roller 31. Therefore, the toner is more uniformly charged.

Because the slats 62*a* partition the toner supply opening 37 into the slits 62*b*, the slats 62*a* serve as a restrictor that allows the toner to pass from the holding chamber 34*a* to the development chamber 34*b* and that restricts flow of toner in the direction from the development chamber 34*b* back into the holding chamber 34*a*. This simple configuration insures that a predetermined amount of toner is maintained in the development chamber 34*b* and borne on the developing roller 31. As a result, images will be formed with greater uniformity in toner density.

Figure 7A:
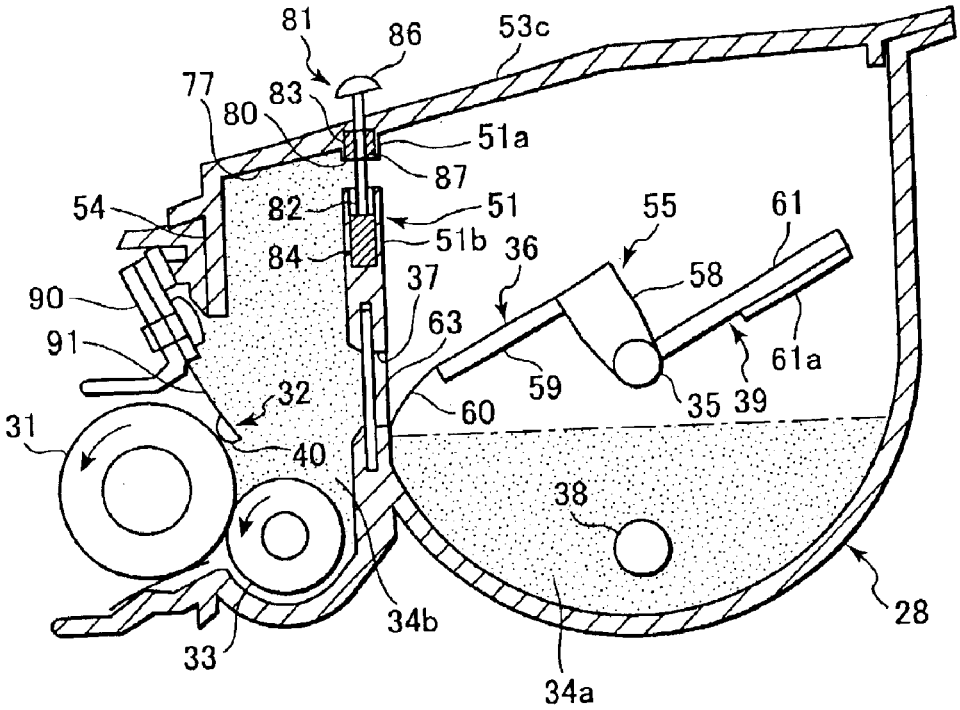
FIG. 7(*a*) is a cross-sectional view showing essential components of a development cartridge according to a second embodiment of the present invention, wherein an upper-side opening between the holding chamber and the development chamber is closed off.
Figure 7B:
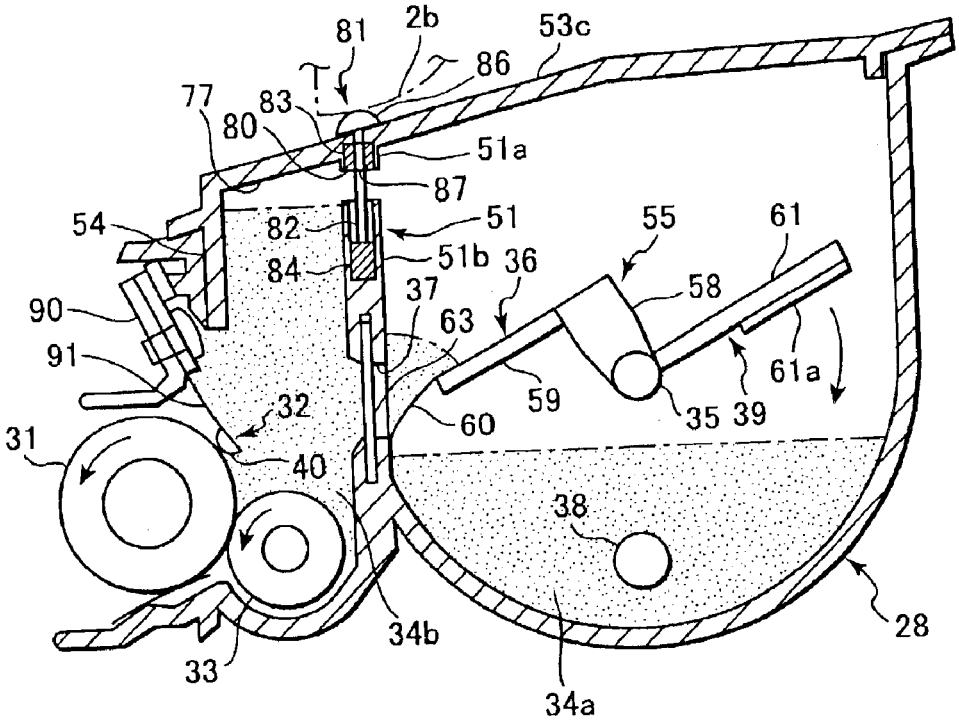

FIGS. 7(*a*) and 7(*b*) show a development cartridge according to a second embodiment of the present invention. In the second embodiment, a pressure relieving opening 80 is formed in the partition wall 51 at a position above the toner supply opening 37. The pressure relieving opening 80 is provided for releasing pressure of the toner that fills the development chamber 34*b*. In FIGS. 7(*a*) and 7(*b*), similar components as in FIGS. 2 to 6(*b*) are indicated by the same reference numbers and their explanation omitted.

As shown in FIGS. 7(*a*) and 7(*b*), the partition wall 51 is divided into an upper partition wall 51*a* and a lower partition wall 51*b*. The pressure relieving opening 80 is defined between the upper partition wall 51*a* and the lower partition wall 51*b*. The pressure relieving opening 80 has a substantially rectangular shape that extends in the widthwise direction of the development chamber 34*b*, that is, following the axial length of the developing roller 31. The pressure relieving opening 80 brings the holding chamber 34*a* and the development chamber 34*b* into fluid communication with each other.

The pressure relieving opening 80 has an elongated and substantially rectangular shape that extends to a width substantially the same as the width of the toner supply opening 37. The upper partition wall 51*a* and the lower partition wall 51*b* are separated by a vertical distance of 3 mm to 10 mm, thereby imparting the pressure relieving opening 80 with a height of 3 mm to 10 mm. It should be noted that the pressure relieving opening 80 need not be formed with the shape described above. For example, the pressure relieving opening 80 could be formed from a plurality of slits each directed in parallel with the toner supply opening 37 and in alignment with the horizontal width thereof.

A shutter mechanism 81 is provided in the pressure relieving opening 80. The shutter mechanism 81 includes a gate member 82, an upper resilient foam member 83, and a lower resilient foam member 84. The gate member 82 has a plate shape that extends following the widthwise direction of the pressure relieving opening 80. The gate member 82 is vertically slidably mounted in the substantial thickness center of both the upper and lower partition walls 51*a*, 51*b*. The gate member 82 is formed with a gate opening 87 at a point midway along the vertical height of the gate member 82. The gate opening 87 has substantial the same shape as the pressure relieving opening 80. A knob 86 is provided at the top end of the gate member 82. The knob 86 has substantially semi-spherical shape.

The upper resilient foam member 83 is fitted in a groove formed in the lower end of the upper partition wall 51*a*. The gate member 82 extends through the upper resilient foam member 83 so that the upper resilient foam member 83 sandwiches the gate member 82 from both the holding chamber 34*a* side and the development chamber 34*b* side.

The lower resilient foam member 84 is fitted in a groove formed in the upper end of the lower partition wall 51*b*. The lower end of the gate member 82 abuts against the upper surface of the lower resilient foam member 84. The resilience of the lower resilient foam member 84 constantly urges the gate member 82 upward.

FIG. 7(*a*) shows condition of the development cartridge 28 of the second embodiment when the development cartridge 28 is not mounted in the laser printer 1. When the development cartridge 28 is not mounted in the laser printer 1, the resilience of the lower resilient foam member 84 pushes the gate member 82 upward. As a result, the knob 86 protrudes to a predetermined position above the upper surface of the development cartridge 28 and the gate opening 87 confronts the upper resilient foam member 83 in the upper partition wall 51*a*. When the gate member 82 is thus positioned, the solid portion of the gate member 82 below the gate opening 87 blocks the pressure relieving opening 80 shut.

FIG. 7(*b*) shows the condition of the development cartridge 28 when the development cartridge 28 is mounted in the laser printer 1. When the development cartridge 28 is mounted in the laser printer 1, the upper edge of the knob 86 abuts against an abutment member 2*b* provided on the main casing 2 of the laser printer 1. The abutment between the upper edge of the knob 86 and the abutment member 2*b* pushes the gate member 82 downward against the resilience of the lower resilient foam member 84. The gate member 82 continues to move downward until the knob 86 contacts the upper portion 53*c* of the casing 53. At this point, the gate opening 87 of the gate member 82 is positioned level with the pressure relieving opening 80 so that fluid communication is established between the holding chamber 34*a* and the development chamber 34*b*.

The series of operations performed up to when the development cartridge 28 is mounted in the laser printer 1 and brought into its normal operation condition for forming images will be described. First, the shutter member 63 is pressed into the development cartridge 28 before the development cartridge 28 is shipped from the factory. This is the same operation as performed before shipment of the development cartridge 28 of the first embodiment, wherein the shutter member 63 is pressed in the direction of arrow A in FIG. 6(*a*). When the shutter member 63 is shifted in this manner, the slit shaped openings are opened up in the toner supply opening 37 so that fluid communication is established between the holding chamber 34*a* and the development chamber 34*b*. Also, the gate member 82 is free to move upward under the urging force of the lower resilient foam member 84. Therefore, as shown in FIG. 7(*a*), the pressure relieving opening 80 is blocked by the solid portion of the pressure relieving opening 80 below the gate opening 87.

Next, a motor (not shown) is connected to the gear 57 of the rotation shaft 35 and driven to rotate the agitator member 55. As a result, the agitator arm 36 conveys toner from the holding chamber 34*a* through the slits 62*b* and into the development chamber 34*b*. Once a sufficient amount of toner fills the development chamber 34*b* as shown in FIG. 7(*a*), the motor is stopped to stop rotation of the agitator arm 36. Then, the external protrusion 65 of the shutter member 63 is released so that the toner supply opening 37 between the holding chamber 34*a* and the development chamber 34*b* is blocked shut. By performing this operation, the development chamber 34*b* can be sufficiently filled with toner before the development cartridge 28 is used.

While in this condition, the development cartridge 28 is shipped from the factory and eventually mounted in the laser printer 1 by a user. In the manner described above in the first embodiment, the action of mounting the development cartridge 28 in the laser printer 1 opens the toner supply opening 37 even before the development cartridge 28 is actually used for development operations. In addition, the action of mounting the development cartridge 28 in the laser printer 1 also opens up the pressure relieving opening 80. As a result, the toner near the ceiling of the development chamber 34*b* can escape through the pressure relieving opening 80 so that pressure in the toner in the development chamber 34*b* is reduced to a certain extent.

Because the pressure relieving opening 80 is maintained closed before the development cartridge 28 is used for development operations, a sufficient amount of toner will be borne on the developing roller 31 when printing operations are started. Also, because the pressure relieving opening 80 is opened up before printing starts, then during printing any toner transported into the development chamber 34*b* by the agitator arm 36 in excess of the predetermined amount will flow through the pressure relieving opening 80 from the development chamber 34*b* back to the holding chamber 34*a*. Therefore, the predetermined amount of toner can be maintained in the development chamber 34*b* even if the agitator arm 36 pushes toner into the development chamber 34*b* with a large pushing force. On the other hand, if the amount of toner in the development chamber 34*b* declines below the predetermined amount, then toner will be continued to be fed into the development chamber 34*b* until the predetermined amount is reached, whereupon any further toner will spill into the holding chamber 34*a* through the pressure relieving opening 80. With this configuration, the predetermined amount of toner can be constantly maintained without excess or shortage. Therefore, the proper amount of toner will always be borne on the developing roller 31 so that image density is uniform, regardless of the amount of toner in the holding chamber 34*a*. Also, the toner in the development chamber 34*b* will always have a sufficiently high fluidity characteristic because the development chamber 34*b* will never be filled with an excessive amount of toner. This insures that the toner is uniformly charged so that good-quality images can be formed.

Figure 8:
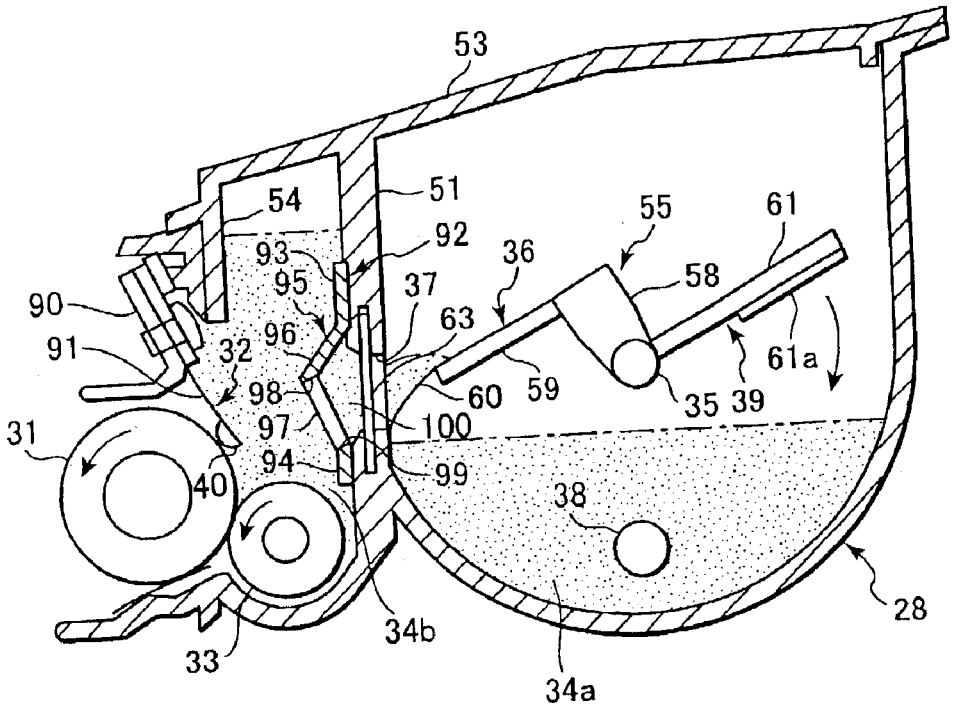
FIG. 8 is a cross-sectional view showing essential components of a development cartridge according to a third embodiment of the present invention.
Figure 9:
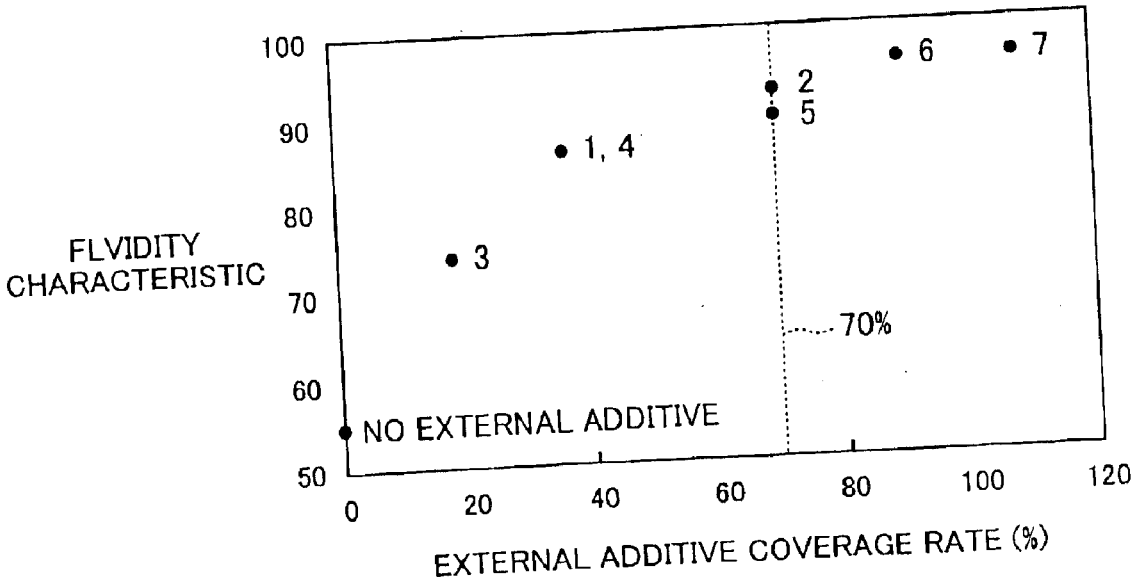
FIG. 9 is a graph showing the relationship between fluidity characteristic and coverage rate of external additive in toner.

FIG. 8 shows a development cartridge 28 according to a third embodiment of the present invention. In this embodiment, two walls, that is, the partition wall 51 and also an auxiliary wall 92, are provided between the holding chamber 34*a* and the development chamber 34*b*. Openings are formed in both of the walls 51, 92 to bring the holding chamber 34*a* and the development chamber 34*b* into fluid communication. In FIG. 8, similar components as in FIGS. 2 to 7(*b*) are indicated by the same reference numbers and their explanation will be omitted.

As shown in FIG. 8, the additional wall 92 is provided in the development chamber 34*b* at a position to the side of the partition wall 51. The auxiliary wall 92 is attached to the development chamber 34*b* side of the partition wall 51 and includes an upper flat portion 93, a lower flat portion 94, and a bent portion 95. The upper flat portion 93 is attached to the partition wall 51 at a position that is adjacent to and vertically above the toner supply opening 37. The lower flat portion 94 is attached to the partition wall 51 at a position that is adjacent to and vertically below the toner supply opening 37. The bent portion 95 is the section of the auxiliary wall 92 located between the upper flat portion 93 and the lower flat portion 94 and has a substantially V-shape in cross section.

The bent portion 95 includes a first slanted wall 96 and a second slanted wall 97. The first slanted wall 96 is continuous with the lower end of the upper flat portion 93 and extends at a downward sloping angle toward the interior of the development chamber 34*b*, that is, in a downstream direction with respect to direction in which toner is conveyed from the holding chamber 34*a* into the development chamber 34*b*. The second slanted wall 97 is a bent section that is continuous with the lower end of the first slanted wall 96 and extends at a downward sloping angle toward the lower flat portion 94.

The second slanted wall 97 is formed with an auxiliary supply opening 98 in its substantially vertical center. The auxiliary opening 98 is located substantially in confrontation with the toner supply opening 37. The auxiliary supply opening 98 is partitioned into slits 99. The slits 99 have substantially the same shape, the same number, and interslit spacing as the slits 62*b* of the toner supply opening 37.

The bent portion 95 in the auxiliary wall 92 forms a space 100 between the partition wall 51 and the auxiliary wall 92. The space 100 is encompassed between the slats or grids 62*a* of the toner supply opening 37 at the partition wall 51, the first slanted wall 96, and the second slanted wall 97.

When the agitator arm 36 begins rotating, toner is pushed from the holding chamber 34*a* through the slits 62*b* of the toner supply opening 37 into the space 100. Further toner supplied from the holding chamber 34*a* into the space 100 pushes the existing toner in the space 100 through the slits 99 and into the development chamber 34*b*. Because the auxiliary supply opening 98 is formed sloping downward, toner passes smoothly downward through the auxiliary supply opening 98 under the toner's own weight. On the other hand, the downward slope of the auxiliary supply opening 98 also reliably prevents the toner once supplied into the holding chamber 34*a* from moving back into the space 100 and further back into the holding chamber 34*a*.

In this way, toner in the holding chamber 34*a* is first pushed by the agitator arm 36 through the toner supply opening 37 and into the space 100. Then, the toner in the space 100 is further conveyed through the auxiliary supply opening 98 and into the development chamber 34*b*. On the other hand, toner in the development chamber 34*b* cannot easily move from the development chamber 34*b* into the space 100 and passage back into the holding chamber 34*a*. Therefore, the toner that has been conveyed into the development chamber 34*b* is reliably prevented from returning to the holding chamber 34*a* through the space 100. As a result, toner is reliably provided in a proper amount on the developing roller 31 and images will be formed with a uniform density.

The development cartridge 28 according to the first to third embodiments are filled with polymerization toner that is substantially spherical. This type of toner has excellent fluidity characteristic and so flows well through the development chamber 34*b*. As a result, images are developed with a uniform toner amount so that resultant images have good quality. This contrasts to the case when non-spherical or angular toner, such as pulverized toner, fills the development chamber 34*b*. In this case, the toner flows poorly through the development chamber 34*b* when packed fairly tightly in the development chamber 34*b*. Image quality can be poor when toner is sedentary and unflowing in this way.

As mentioned previously, the laser printer 1 uses non-magnetic, single-component toner. To form images with non-magnetic, single-component toner, the developing roller 31 should always bear a fixed amount of toner and the toner should have as close to the same charge as possible. The development cartridge 28 of all three embodiments insures that the development chamber 34*b* is filled with a sufficient amount of toner at all times. Therefore, the developing roller 31 will always bear a fixed amount of toner so that images can be properly formed.

The laser printer 1 can form images with substantially uniform toner density even in normally problematic situations, such as the first time the development cartridge 28 is used after first being mounted in the laser printer 1 or after the laser printer 1 has not been used for a long period of time. The first time development cartridge is used after being mounted in a laser printer is normally problematic because toner has not been sufficiently transported by the agitator yet. However, this problem is overcome by all of the embodiments described above.

Experiments were performed to determine the optimal components of toner to use in the development cartridge 28. Different toners tested are shown in Table 1. The different toners tested had the different ratios of small-diameter external additive S and large-diameter external additive L (including a toner with no external additive) shown in Table 1. The small-diameter external additive S has a BET surface area of 110 $m^2/g$ and a weight average particle diameter of 20 nm, and the large-diameter external additive L has a BET surface area of 40 $m^2/g$ and a weight average particle diameter of 40 nm. The images were printed in two situations: directly after printing started (initial use) and after the laser printer 1 had been left unused for a fixed period of time (after period of non-use). The quality of the resultant images were evaluated as shown in Table 1.

TABLE 1

| TEST | COMPARATIVE EXAMPLE | NO EXTERNAL ADDITIVE | 1 | 2 | 3 | 4 | 5 | 6 | 7 |
|---|---|---|---|---|---|---|---|---|---|
| FEATURES OF SAMPLE | | | | | | | | | |
| EXTERNAL ADDITIVE S AMOUNT | 1.0 wt % | 0.0 wt % | 0.5 wt % | 1.0 wt % | 0.0 wt % | 0.0 wt % | 0.5 wt % | 1.0 wt % | 1.0 wt % |
| EXTERNAL ADDITIVE L AMOUNT | 1.0 wt % | 0.0 wt % | 0.0 wt % | 0.0 wt % | 0.5 wt % | 1.0 wt % | 1.0 wt % | 0.5 wt % | 1.0 wt % |

TABLE 1-continued

| TEST | COMPARATIVE EXAMPLE | NO EXTERNAL ADDITIVE | 1 | 2 | 3 | 4 | 5 | 6 | 7 |
|---|---|---|---|---|---|---|---|---|---|
| EXTERNAL ADDITIVE COVERAGE RATE | 108% | 0% | 36% | 70% | 18% | 36% | 70% | 90% | 108% |
| EVALUATION | | | | | | | | | |
| FLUIDITY CHARACTERISTIC | 95 | 55 | 86 | 92 | 74 | 86 | 89 | 95 | 95 |
| INITIAL USE | D | F | C* | A | C** | C** | A | A | A |
| AFTER PERIOD OF NON-USE | D | F | C** | C* | C** | B | A | A | A |

A: Images were printed with uniform toner density from the first sheet.
B: Images were printed with uniform toner density from the 10th sheet or sooner.
C: Images were printed with uniform toner density from the 50th sheet or sooner.
D: Images were printed with uniform toner density about the 100th sheet to the 150th sheet.
F: Print quality degraded at image transfer.
*Images were printed with uniform toner density at about the 20th sheet.
**Images were printed with uniform toner density at about the 50th sheet.

Figure 1:
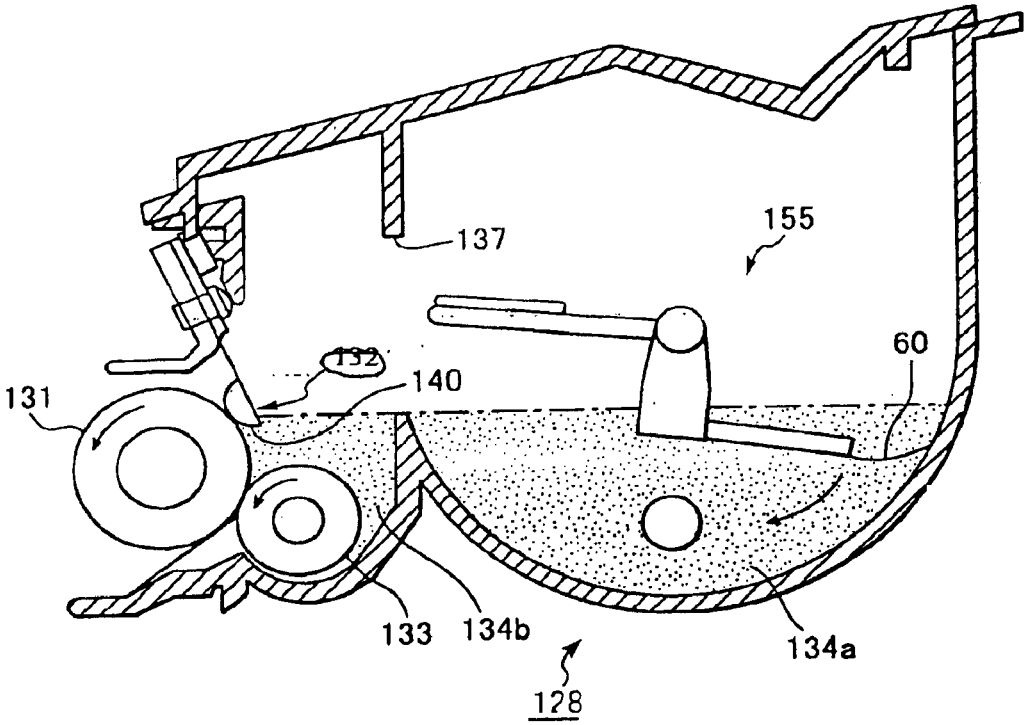
FIG.1 PRIOR ART
FIG. 1 is a cross-sectional view showing essential components of a conventional development cartridge.

The toner samples 1 to 7 and the toner sample with no external additive were tested using the development cartridge 28 shown in FIG. 1. On the other hand, regarding the comparative examples, the conventional development cartridge 128 shown in FIG. 1 was used. It should be noted that the development cartridge 128 used for the comparative examples has no pressing member 68. Moreover, the toner supply opening 137 of the development cartridge 128 is a continuous opening across its entire horizontal width and includes no configuration similar to the slats 62*a* described in the embodiments of the present invention. Therefore, toner conveyed into the development chamber 134*b* by the agitator member 155 merely flows back into the holding chamber 134*a*. The toner in the development chamber 134*b* if distributed equally throughout the entire volume of the development chamber 134*b* would have a toner density that is only 0.2 to 0.4 times that of the sifted apparent density of the toner. Further, the actual toner density in its settled condition over the supply roller 133 is only 1.0 to 1.2 times the sifted apparent density.

As shown in Table 1, the comparative example used the toner the same as that used in Example 7. However, regarding the comparative example, toner density in printed images did not stabilize until about 100 to 150 sheets where printed both after printing was started the first time and after the development cartridge 128 had not been used for a long period of time. Also, in the test performed using toner with no external additive, printing quality was degraded by poor image transfer from the developing roller 131 to the photosensitive drum. As shown by the results of Examples 1, 3, and 4, when images were printed using toner with an external additive coverage rate of 40% or less and with a fluidity characteristic of 86 or less, the toner density of images did not stabilize unit 20 to 50 sheets were printed from the start of printing operations.

On the other hand, as shown by the test results of Example 2, addition of only external toner S (which has a small weight-average particle diameter) at 1.0% by weight achieved a high external additive coverage rate of 70% and a sufficiently high fluidity characteristic of 92. Therefore, the toner density of images was stable right from the start of the first use of the development cartridge 28. However, because the toner of test 2 includes no external toner L (which has a large weight-average particle diameter), the toner density of images did not stabilize until about 20 sheets where printed after the development cartridge 28 was left unused for a time. In this sense, the toner used in test 2 was slightly inferior to those used in tests 5, 6, and 7.

As can be seen from the test results of Examples 5, 6, and 7, when the two types of small-diameter external additive S and L are both added each at rates of 0.5% by weight or more, toner density was stable from the start both after printing was started the first time and after the development cartridge 128 had not been used for a time. Although not shown in Table 1, when the external additives S and L were each added at rates of 1.5% by weight, then in the same manner as shown for Examples 5, 6, and 7 toner density was stable from the start both after printing was started the first time and after the development cartridge 128 had not been used for a time.

From these test results, it can be determined that it is desirable that the toner filling the development chamber 34*b* include both the small-diameter external additive S, which has a weight average particle diameter of 20 nm, and the large-diameter external additive L, which has a weight average particle diameter of 40 nm, both at rates of from 0.5% to 1.5% by weight. In these amounts, the external additives S and L provide synergetic effects. That is, small-diameter external additive S added at this rate gives the toner a sufficiently high fluidity characteristic so that the toner will be reliably supplied to the supply roller 33. Also, large-diameter external additive L prevents the small-diameter external additive S from embedding into the toner particles so that the toner density of printed images will be stable from the first use of the development cartridge 28 and after the development cartridge 28 is not used for a long period. The laser printer 1 will be able to print images with a more uniform toner density.

Here a summary of the desirable characteristics of the toner used in the development cartridge 28 will be provided. It is desirable that the toner have a fluidity characteristic of 89 or greater. It is desirable that the external additive coverage rate be 70% or greater. Further, it is desirable that the toner include at least two types of external additive, each with a different weight average particle diameter. It is desirable that at least one of the two types has a weight average particle diameter of 30 nm or smaller.

It is desirable that this toner fill the development chamber 34*b* at a density with respect to the volume of the development chamber 34*b* that is greater than the sifted apparent density of the toner. As a result, toner can be supplied in sufficient amounts to the supply roller 33. Consequently, the developing roller 31 will always bear a stable amount of toner per unit surface area of the developing roller 31. Therefore, images will be printed with a consistent toner density even directly after the development cartridge 28 is first used.

It is desirable that this toner fill the development chamber 34*b* to a depth of 25 mm or greater from the upper surface of the supply roller 33. In this case, the toner presses down on the supply roller 33 from the weight of the toner, so that toner is reliably supplied to the supply roller 33 and, consequently, to the developing roller 31. For this reason, the developing roller 31 will always bear the proper amount of toner. The developing roller 31 will always bear a stable amount of toner per unit surface area of the developing roller 31. Therefore, images will be printed with a consistent toner density even directly after the development cartridge 28 is first used. Further, because remaining one of the two types of external additive has a weight average particle diameter of 40 nm or greater, images are formed with a stable toner density.

While some exemplary embodiments of the invention have been described in detail, those skilled in the art will recognize that there are many possible modifications and variations which may be made in these exemplary embodiments while yet retaining many of the novel features and advantages of the invention.

For example, the embodiments describe the toner supply opening 37 as being divided into vertically elongated slits that are aligned in a single horizontal (widthwise) row and that are separated from each other by a predetermined spacing. However, the shape of the slits is not limited to that described in the embodiments. For example, the slits could be horizontally elongated. Also, more than a single row of slits could be provided.

Further, the embodiment described the slats 62*a* as an example of a restrictor in the toner supply opening 37 that restricts movement of toner from the development chamber 34*b* to the holding chamber 34*a*. However, the restrictor of the present invention could be any member that restricts movement of the toner in this manner, such as a metal mesh or brush-shaped member disposed in the toner supply opening 37.

Further, the embodiments describe that the slats 62*a* are provided integrally with the partition wall 51 at a position of the opening. However, a separate restrictor member can be prepared, and the restrictor member can be assembled into an opening formed in the partition wall 51.

In the third embodiment shown in FIG. 8, the slits 62*b* and the slits 99 are formed with substantially the same shape. However, the slits 62*b* and the slits 99 can be formed with different shapes. For example, the slits 62*b* can be formed with a vertically elongated rectangular shape and the slits 99 can be formed with a horizontally elongated rectangular shape.

The embodiments described the shutter member 63 as an example of a member for blocking fluid communication between the holding chamber 34*a* and the development chamber 34*b*. However, a seal member that covers the toner supply opening 37 can be used instead. In this case, the seal member is adhered to the toner supply opening 37 before the development cartridge 28 is used in order to block closed the toner supply opening 37. Immediately before the development cartridge 28 is mounted into the laser printer 1, the seal member is peeled off the toner supply opening 37 in order to open up the toner supply opening 37. A seal member can also be used in this way to cover the pressure relieving opening 80.

The first embodiment describes the pressing member 68 as being manually operated, that is, the user pulls up on the knob 69 after the development cartridge 28 is mounted into the laser printer 1. However, the pressing member 68 can be designed to automatically rise upward when the development cartridge 28 is mounted into the laser printer 1.

The embodiments describe the common main casing 2 as defining both the holding chamber 34*a* and the development chamber 34*b*. However, a separate casing can be provided for defining the holding chamber and this separate casing can be designed for easy attachment to and detachment from the casing of the development chamber 34*b*. Further, although the embodiments describe that the developing roller develops electrostatic latent image on a photosensitive drum, the developing roller could develop images on any type of a photosensitive member, such as photosensitive endless belt.

What is claimed is:

1. A development unit developing an electrostatic latent image using developing agent into a visible image comprising:

a holding chamber wall defining a holding chamber for holding therein the developing agent;

a development chamber wall defining a development chamber;

a partition wall interposed between the holding chamber and the development chamber, the partition wall being formed with a through hole for bringing the holding chamber into fluid communication with the development chamber;

a conveyor disposed in the holding chamber for conveying the development agent from the development chamber to the holding chamber through the through hole; and a restrictor provided to partly block the through hole, the restrictor allowing the development agent conveyed by the conveyor to pass through the through hole from the holding chamber to the development chamber and restricting passage of developing agent through the through hole from the development chamber to the holding chamber;

a developing agent bearing member provided in the development chamber, the developing agent bearing member developing agent for developing images; and a supply member located in the development chamber for supplying the developing agent to the developing agent bearing member, wherein the development chamber wall includes an inner ceiling located above the supply member, the supply member being vertically spaced away from the inner ceiling by 33 mm or more; and wherein the developing agent bearing member, the supply member, and the conveyor are arrayed in a substantially horizontal direction.

2. The development unit as claimed in claim 1, wherein the developing chamber and the through hole provide a geometrical relation to allow the developing agent to be conveyed by the conveyor onto an upper portion of the supply member.

3. The development unit as claimed in claim 1, wherein the supply member is located in the development chamber at a position below the developing agent in the development chamber with respect to direction of gravitational pull whereby weight of the developing agent presses downward on the supply member.

4. The development unit as claimed in claim 3, wherein the developing agent bearing member is located in the development chamber at a position beside the supply member, and opposite to the through hole with respect to the supply member, the development unit further comprising:

a layer thickness regulating member positioned beside the developing agent bearing member for regulating a thickness of a layer of the developing agent borne on the developing agent bearing member to a predetermined thickness, the layer thickness regulating member being located in the development chamber at a position in between the conveyed developing agent and the developing agent bearing member for restricting a direct application of weight of the conveyed developing agent onto the developing agent bearing member.

5. The development unit as claimed in claim 1, wherein the developing agent filled in the development chamber defines a top surface level whose height is 25 mm or greater from the supply member in an initial phase prior to a first development operation.

6. The development unit as claimed in claim 1, further comprising a pressing member disposed in the development chamber for pressing the developing agent in the development chamber toward the supply member.

7. The development unit as claimed in claim 6, wherein the pressing member comprises a pressing portion in pressure contact with the developing agent in the development chamber, and a releaser maintaining a position of the pressing portion at a position away from the developing agent.

8. The development unit as claimed in claim 1, wherein the supply member and the developing member are disposed in contact with each other.

9. The development unit as claimed in claim 1, further comprising an image bearing member including an image forming region that extends to a predetermined length in a predetermined direction, the through hole extending to a length in the predetermined direction and having a length substantially the same as the length of the image forming region.

10. The development unit as claimed in claim 1, further comprising an image bearing member including an image forming region that extends to a predetermined length in a predetermined direction, the conveyor having a width in the predetermined direction that is substantially the same as the length of the image forming region.

11. The development unit as claimed in claim 1, wherein the through hole has an elongated shape, the conveyor conveying developing agent substantially uniformly along an entire length of the through hole.

12. The development unit as claimed in claim 1, wherein the restrictor comprises a plurality of slats aligned in the through hole, the slats defining open slits therebetween.

13. The development unit as claimed in claim 1, further comprising a second wall disposed beside the partition wall in a conveying direction of the developing agent from the holding chamber to the development chamber, the second wall being formed with a second through hole.

14. The development unit as claimed in claim 1, further comprising a blocking member for blocking passage of developing agent through the through hole between the holding chamber and the development chamber.

15. The development unit as claimed in claim 14, wherein he blocking member is movable between a first position for closing the through hole and a second position for opening the through hole to selectively allow and block passage of developing agent through the through hole.

16. The development unit as claimed in claim 14, wherein the developing agent is maintained in the development chamber at a higher density with respect to total volume of the development chamber than a sifted apparent density of the developing agent in an initial phase prior to a first development operation while maintaining the first position of the blocking member.

17. The development unit as claimed in claim 1, wherein the restrictor and the conveyor have configurations to allow the developing agent to pass into the development chamber until a predetermined amount of developing agent exists in the development chamber, whereupon pressure in the developing agent in the development chamber is substantially equal to a force generated by the conveyor to push developing agent into the development chamber.

18. The development unit as claimed in claim 1, wherein the partition wall is further formed with a gate hole at a position above the through hole, the gate hole allowing developing agent to pass from the development chamber into the holding chamber when excessive amount of the developing agent exists in the development chamber.

19. The development unit as claimed in claim 1, wherein the developing agent comprises non-magnetic, single-component toner.

20. The development unit as claimed in claim 1, wherein the developing agent is substantially spherical toner.

21. The development unit as claimed in claim 1, wherein the developing agent has a fluidity characteristic of not less than 89.

22. The development unit as claimed in claim 21, wherein the developing agent includes at least a first type external additive having a first average particle diameter and a second type external additive having a second average particle diameter different from the first average particle diameter.

23. The development unit as claimed in claim 22, wherein the first type external additive has a weight average particle diameter of not less than 40 nm.

24. The development unit as claimed in claim 22, wherein the first type external additive and the second type external additive are contained in the developing agent at respective rates of 0.5 to 1.5% by weight.

25. The development unit as claimed in claim 1, wherein the developing agent includes an external additive with a particle coverage rate of not less than 70%.

26. The development unit as claimed in claim 25, wherein the developing agent includes at least a first type external additive having a first average particle diameter and a second type external additive having a second average particle diameter different from the first average particle diameter.

27. The development unit as claimed in claim 26, wherein the first type external additive has a weight average particle diameter of not less than 40 nm.

28. The development unit as claimed in claim 26, wherein the first type external additive and the second type external additive are contained in the developing agent at respective rates of 0.5 to 1.5% by weight.

29. The development unit as claimed in claim 1, wherein the developing agent includes at least a first type external additive having a first average particle diameter and a second type external additive having a second average particle diameter different from the first average particle diameter, and wherein the second type external additive has a weight average particle diameter of not more than 30 nm.

30. The development unit as claimed in claim 29, wherein the first type external additive has a weight average particle diameter of not less than 40 nm.

31. The developing unit as claimed in claim 29, wherein the first type external additive and the second type external additive are contained in the developing agent at respective rates of 0.5 to 1.5% by weight.

32. A process unit detachably mounted in a main casing of an image forming device, the process unit comprising:

a photosensitive unit;

a scorotron charge unit;

a transfer unit;

a holding chamber wall defining a holding chamber for holding therein developing agent;

a development chamber wall defining a development chamber;

a partition wall interposed between the holding chamber and the development chamber, the partition wall being formed with a through hole for bringing the holding chamber into fluid communication with the development chamber;

a conveyor disposed in the holding chamber for conveying the developing agent from the development chamber to the holding chamber through the through hole;

a restrictor provided to partly block the through hole, the restrictor allowing the developing agent conveyed by the conveyor to pass through the through hole from the holding chamber to the development chamber and restricting passage of developing agent through the through hole from the development chamber to the holding chamber;

a development agent bearing member provided in the development chamber, the developing agent bearing member bearing the developing agent for developing images; and a supply member located in the development chamber for supplying the developing agent to the developing agent bearing member, wherein the development chamber wall includes an inner ceiling located above the supply member being vertically spaced away from the inner ceiling by 30 mm or more; and wherein the developing agent bearing member, the supply member, and the conveyor are arrayed in a substantially horizontal direction.

33. A development unit that, in a normal operation condition for image formation, develops electrostatic latent images using developing agent, the development unit comprising:

a holding chamber wall defining a holding chamber for holding the developing agent;

a development chamber wall defining a development chamber;

a partition wall partitioning the holding chamber from the development chamber, the partition wall being formed with a through hole for bringing the holding chamber into fluid communication with the development chamber;

a developing agent transport unit for pushing the developing agent in the holding chamber through the through hole to the development chamber during the normal operation condition; and a maintainer disposed in the through hole for maintaining, at least during the normal operation condition, developing agent in the development chamber at a higher level then where the developing agent transport unit pushes the developing agent regardless of an amount of the developing agent in the holding chamber.

34. The development unit as claimed in claim 33, further comprising:

a developing agent bearing member provided in the development chamber, the developing agent bearing member bearing developing agent for developing images; and a supply member located in the development chamber for supplying the developing agent to the developing agent bearing member.

35. The development unit as claimed in claim 34, wherein during the normal operation condition, the maintainer maintains the developing agent in the development chamber to a height of 25 mm or greater from the supply member.

36. The development unit as claimed in claim 35, wherein the developing agent has a fluidity characteristic of not less than 89.

37. The development unit as claimed in claim 35, wherein the developing agent includes en external additive with a particle coverage rate of not less than 70%.

38. The development unit as claimed in claim 35, wherein the developing agent includes at least two different types of external additive, the different types of external additive having different average particle diameters, at least one of the different types of external additive having a weight average particle diameter of 30 nm or less.

39. The development unit as claimed in claim 33, wherein the development chamber wall includes an inner ceiling located vertically above the developing agent in the development chamber, and further comprising a space opening unit that opens a space between the developing agent in the development chamber and the inner ceiling during the normal operation condition.

40. The development unit as claimed in claim 33, wherein during the normal operation condition the maintainer maintains developing agent in the development chamber at a rate of 2 g or more per each 1 cm of horizontal width of the development chamber.

41. The development unit as claimed in claim 33, wherein during the normal operation condition the maintainer maintains the developing agent in the development chamber at a higher density with respect to total volume of the development chamber than sifted apparent density of the developing agent.

42. The development unit as claimed in 41, wherein during the normal operation condition the maintainer maintains the developing agent above and adjacent to the supply member at a density that is 1.5 times or greater than the sifted apparent density of the developing agent.

43. The development unit as claimed in claim 41, wherein the developing agent has a fluidity characteristic of not less than 89.

44. The development unit as claimed in claim 41, wherein the developing agent includes an external additive with a particle coverage rate of 70% or greater.

45. The development unit as claimed in claim 41, wherein the developing agent includes at least two different types of external additive, the different types of external additive having different average particle diameters, at least one of the different types of external additive having a weight average particle diameter of 30 nm or less.

46. A development unit that performs a developing operation to develop electrostatic latent images with developing agent, the development unit comprising:

a holding chamber wall defining a holding chamber for holding therein the developing agent;

a development chamber wall defining a development chamber;

a partition wall partitioning the holding chamber from the development chamber, the partition wall being formed with a through hole allowing fluid communication between the holding chamber and the development chamber; and a blocking member provided in association with the through hole for selectively blocking the through hole to maintain developing agent in the development chamber at a higher density with respect to total volume of the development chamber than a sifted apparent density of the developing agent.

47. A development unit developing an electrostatic latent image using developing agent into a visible image comprising:

a holding chamber wall defining a holding chamber for holding therein the developing agent;

a development chamber wall defining a development chamber;

a partition wall interposed between the holding chamber and the development chamber, the partition wall being formed with a through hole for bringing the holding chamber into fluid communication with the development chamber;

a conveyor disposed in the holding chamber for conveying the developing agent from the development chamber to the holding chamber through the through hole;

a restrictor provided to partly block the through hole, the restrictor allowing the developing agent conveyed by the conveyor to pass through the through hole from the holding chamber to the development chamber and restricting passage of developing agent through the through hole from the development chamber to the holding chamber;

a developing agent bearing member provided in the development chamber, the developing agent bearing member bearing developing agent for developing images; and a supply member located in the development chamber for supplying the developing agent to the developing agent bearing member, wherein the developing agent filled in the development chamber defines a top surface level whose height is 25 mm or greater from the supply member in an initial phase prior to a first development operation, and wherein the developing agent bearing member, the supply member, and the conveyor are arrayed in a substantially horizontal direction.

48. The development unit as claimed in claim 47, wherein the developing chamber and the through hole provide a geometrical relation to allow the developing agent to be conveyed by the conveyor onto an upper portion of the supply member.

49. The development unit claimed in claim 47, wherein the supply member is located in the development chamber at a position below the developing agent in the development chamber with respect to direction of gravitational pull whereby weight of the developing agent presses downward on the supply member.

50. The development unit as claimed in claim 49, wherein the developing agent bearing member is located in the development chamber at a position beside the supply member, and opposite to the through hole with respect to the supply member, and the development unit further comprising:

a layer thickness regulating member positioned beside the developing agent bearing member for regulating a thickness of a layer of the developing agent borne on the developing agent bearing member to a predetermined thickness, the layer thickness regulating member being located in the development chamber at a position in between the conveyed developing agent and the developing agent bearing member for restricting a direct application of weight of the conveyed developing agent onto the developing agent bearing member.

51. The development unit as claimed in claim 47, wherein the development chamber wall includes an inner ceiling located above the supply member, the supply member being vertically spaced away from the inner ceiling by 30 mm or more.

52. The development unit as claimed in claim 47, further comprising a pressing member disposed in the development chamber for pressing the developing agent in the development chamber toward the supply member.

53. The development unit as claimed in claim 52, wherein the pressing member comprises a pressing portion in pressure contact with the developing agent in the development chamber, and a releaser maintaining a position of the pressing portion at a position away from the developing agent.

54. The development unit as claimed in claim 47, wherein the supply member and the developing member are disposed in contact with each other.

55. The development unit as claimed in claim 47, further comprising an image bearing member including an image forming region that extends to a predetermined length in a predetermined direction, the through hole extending to a length in the predetermined direction and having a length substantially the same as the length of the image forming region.

56. The development unit as claimed in claim 47, further comprising an image bearing member including an image forming region that extends to a predetermined length in a predetermined direction, the conveyor having a width in the predetermined direction that is substantially the same as the length of the image forming region.

57. The development unit as claimed in claim 47, wherein the through hole has an elongated shape, the conveyor conveying developing agent substantially uniformly along an entire length of the through hole.

58. The development unit as claimed in claim 47, wherein the restrictor comprises a plurality of slats aligned in the through hole, the slats defining open slits therebetween.

59. The development unit as claimed in claim 47, further comprising a second wall disposed beside the partition wall in a conveying direction of the developing agent from the holding chamber to the development chamber, the second wall being formed with a second through hole.

60. The development unit as claimed in claim 47, further comprising a blocking member for blocking passage of developing agent through the through hole between the holding chamber and the development chamber.

61. The development unit as claimed in claim 60, wherein the blocking member is movable between a first position for closing the through hole and a second position for opening the through hole to selectively allow and block passage of developing agent through the through hole.

62. The development unit as claimed in claim 60, wherein the developing agent is maintained in the development chamber at a higher density with respect to total volume of the development chamber than a sifted apparent density of the developing agent in an initial phase prior to a first development operation while maintaining the first position of the blocking member.

63. The development unit as claimed in claim 47, wherein the restrictor and the conveyor have configurations to allow the developing agent to pass into the development chamber until a predetermined amount of developing agent exists in the development chamber, whereupon pressure in the developing agent in the development chamber is substantially equal to a force generated by the conveyor to push developing agent into the development chamber.

64. The development unit as claimed in claim 47, wherein the partition wall is further formed with a gate hole at a position above the through hole, the gate hole allowing developing agent to pass from the development chamber into the holding chamber when excessive amount of the developing agent exists in the development chamber.

65. The development unit as claimed in claim 47, wherein the developing agent comprises non-magnetic, single-component toner.

66. The development unit as claimed in claim 47, wherein the developing agent is substantially spherical toner.

67. The development unit as claimed in claim 47, wherein the developing agent has a fluidity characteristic of not less than 89.

68. The development unit as claimed in claim 67, wherein the developing agent includes at least a first type external additive having a first average particle diameter and a second type external additive having a second average particle diameter different from the first average particle diameter.

69. The development unit as claimed in claim 68, wherein the first type external additive has a weight average particle diameter of not less than 40 nm.

70. The development unit as claimed in claim 68, wherein the first type external additive and the second type external additive are contained in the developing agent at respective rates of 0.5 to 1.5% by weight.

71. The development unit as claimed in claim 47, wherein the developing agent includes an external additive with a particle coverage rate of not less than 70%.

72. The development unit as claimed in claim 71, wherein the developing agent includes at least a first type external additive having a first average particle diameter and a second type external additive having a second average particle diameter different from the first average particle diameter.

73. The development unit as claimed in claim 72, wherein the first type external additive has a weight average particle diameter of not less than 40 nm.

74. The development unit as claimed in claim 72, wherein the first type external additive and the second type external additive are contained in the developing agent at respective rates of 0.5 to 1.5% by weight.

75. The development unit as claimed in claim 47, wherein the developing agent includes at least a first type external additive having a first average particle diameter and a second type external additive having a second average particle diameter different from the first average particle diameter, and wherein the second type external additive has a weight average particle diameter of not more than 30 nm.

76. The development unit as claimed in claim 75, wherein the first type external additive has a weight average particle diameter of not less than 40 nm.

77. The developing unit as claimed in claim 75, wherein the first type external additive and the second type external additive are contained in the developing agent at respective rates of 0.5 to 1.5% by weight.

78. A development unit developing an electrostatic latent image using developing agent into a visible image comprising:

a holding chamber wall defining a holding chamber for holding therein the developing agent;

a development chamber wall defining a development chamber;

a partition wall interposed between the holding chamber and the development chamber, the partition wall being formed with a through hole for bringing the holding chamber into fluid communication with the development chamber;

a conveyor disposed in the holding chamber for conveying the developing agent from the development chamber to the holding chamber through the through hole;

a developing agent bearing member provided in the development chamber, the developing agent bearing member bearing developing agent for developing images; and a supply member located in the development chamber for supplying the developing agent to the developing agent bearing member, wherein the developing agent filled in the development chamber defines a top surface level whose height is 25 mm or greater from the supply member in an initial phase prior to a first development operation, and wherein the developing agent bearing member, the supply member, and the conveyor are arrayed in a substantially horizontal direction.

79. A development unit developing an electrostatic latent image using developing agent into a visible image comprising:

a holding chamber wall defining a holding chamber for holding therein the developing agent;

a development chamber wall defining a development chamber;

a partition wall interposed between the holding chamber and the development chamber, the partition wall being formed with a through hole for bringing the holding chamber into fluid communication with the development chamber;

a conveyor disposed in the holding chamber for conveying the developing agent from the development chamber to the holding chamber through the through hole; and a restrictor provided to partly block the through hole, the restrictor allowing the developing agent conveyed by the conveyor to pass through the through hole from the holding chamber to the development chamber and restricting passage of developing agent through the through hole from the development chamber to the holding chamber, wherein the restrictor and the conveyor have configurations to allow the developing agent to pass into the development chamber until a predetermined amount of developing agent exists in the development chamber, whereupon pressure in the developing agent in the development chamber is substantially equal to a force generated by the conveyor to push developing agent into the development chamber.

80. A development unit developing an electrostatic latent image using developing agent into a visible image comprising:

a holding chamber wall defining a holding chamber for holding therein the developing agent;

a development chamber wall defining a development chamber;

a partition wall interposed between the holding chamber and the development chamber, the partition wall being formed with a through hole for bringing the holding chamber into fluid communication with the development chamber;

a conveyor disposed in the holding chamber for conveying the developing agent from the development chamber to the holding chamber through the through hole; and a restrictor provided to partly block the through hole, the restrictor allowing the developing agent conveyed by the conveyor to pass through the through hole from the holding chamber to the development chamber and restricting passage of developing agent through the through hole from the development chamber to the holding chamber, wherein the partition wall is further formed with a gate hole at a position above the through hole, the gate hole allowing developing agent to pass from the development chamber into the holding chamber when excessive amount of the developing agent exists in the development chamber.

* * * * *